US007286980B2

(12) United States Patent
Wang et al.

(10) Patent No.: US 7,286,980 B2
(45) Date of Patent: Oct. 23, 2007

(54) SPEECH PROCESSING APPARATUS AND METHOD FOR ENHANCING SPEECH INFORMATION AND SUPPRESSING NOISE IN SPECTRAL DIVISIONS OF A SPEECH SIGNAL

(75) Inventors: Youhua Wang, Kanazawa (JP); Koji Yoshida, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 991 days.

(21) Appl. No.: 10/111,974

(22) PCT Filed: Aug. 31, 2001

(86) PCT No.: PCT/JP01/07518

§ 371 (c)(1),
(2), (4) Date: Apr. 30, 2002

(87) PCT Pub. No.: WO02/19319

PCT Pub. Date: Mar. 7, 2002

(65) Prior Publication Data

US 2003/0023430 A1 Jan. 30, 2003

(30) Foreign Application Priority Data

Aug. 31, 2000 (JP) ..... 2000-264197
Aug. 29, 2001 (JP) ..... 2001-259473

(51) Int. Cl.
*G10L 19/14* (2006.01)

(52) U.S. Cl. ..... 704/205; 704/207

(58) Field of Classification Search ..... 704/205, 704/207

See application file for complete search history.

(56) References Cited

U.S. PATENT DOCUMENTS 3,691,486 A * 9/1972 Borsuk et al. ..... 333/166
4,108,040 A * 8/1978 Chibana et al. ..... 84/608
4,417,337 A * 11/1983 Favin et al. ..... 714/714
5,293,588 A * 3/1994 Satoh et al. ..... 704/233
5,434,912 A * 7/1995 Boyer et al. ..... 379/202.01
5,673,024 A * 9/1997 Frederick et al. ..... 340/572.4
6,366,880 B1 4/2002 Ashley
6,415,253 B1 * 7/2002 Johnson ..... 704/210

(Continued)

FOREIGN PATENT DOCUMENTS

JP 60263199 12/1985

(Continued)

OTHER PUBLICATIONS

International Search Report dated Dec. 25, 2001.

(Continued)

*Primary Examiner*—David Hudspeth
*Assistant Examiner*—Jakieda R. Jackson
(74) *Attorney, Agent, or Firm*—Stevens, Davis, Miller & Mosher, LLP

(57) ABSTRACT

A speech processing apparatus and method may identify divisions of a signal spectrum as having a speech component or having no speech component. A comb filter is generated, based on a high-accuracy speech pitch obtained in the identified speech component divisions, for enhancing speech information in the speech component divisions. The comb filter is applied to the speech component divisions to suppress noise.

17 Claims, 29 Drawing Sheets

U.S. PATENT DOCUMENTS 7,003,120 B1 * 2/2006 Smith et al. ..... 381/61

FOREIGN PATENT DOCUMENTS

| | | |
|---|---|---|
| JP | 03212698 | 9/1991 |
| JP | 07160294 | 6/1995 |
| JP | 08044397 | 2/1996 |
| JP | 08223677 | 8/1996 |
| JP | 09212196 | 8/1997 |
| JP | 09311698 | 12/1997 |
| JP | 10049197 | 2/1998 |
| JP | 105513030 | 12/1998 |
| JP | 11038999 | 2/1999 |
| JP | 2000 105599 | 4/2000 |
| WO | 8700366 | 1/1987 |
| WO | 8903141 | 4/1989 |
| WO | 0141129 | 6/2001 |

OTHER PUBLICATIONS

Steven F. Boll; "Suppression of Acoustic Noise in Speech Using Spectral Subtraction", IEEE Transactions on Acoustics, Speech, and Signal Processing, vol. ASSP-27, No. 2, Apr. 1979, pp.113-120.

Robert J. McAulay, et al.; "Speech Enhancement Using a Soft-Decision Noise Suppression Filter", IEEE Transactions on Acoustics, Speech, and Signal Processing, vol. ASSP-28, No. 2, Apr. 1980, pp. 137-145.

* cited by examiner

```
if ( SN R(n) > Θ ) {
 SP(n) = 1;   /* SPEECH FRAME */
 cont = 0;
}
else {
 cont = cont + 1;
}
if ( cont >10 ) {   /* SN R(n)≦Θ ON TEN OR MORE SUCCESSIVE
FRAMES */
 SP(n) = 0;   /* NOISE FRAME */
 cont = 0;
}
```

FIG. 22

SPEECH PROCESSING APPARATUS AND METHOD FOR ENHANCING SPEECH INFORMATION AND SUPPRESSING NOISE IN SPECTRAL DIVISIONS OF A SPEECH SIGNAL

TECHNICAL FIELD

The present invention relates to a speech processing apparatus and speech processing method for suppressing noises, and more particularly, to a speech processing apparatus and speech processing method in a communication system.

BACKGROUND ART

Conventional speech coding techniques enable speech communications of high quality in speeches with no noises, but have such a problem that in speeches including noises or the like, grating noises specific to digital communications occur and the speech quality deteriorates.

As a speech enhancing technique for suppressing such a noise, there are a spectral subtraction method and comb filtering method.

The spectral subtraction method is to suppress a noise by estimating characteristics of a noise in a non-speech interval with attention focused on noise information, subtracting the short-term power spectrum of the noise or multiplying an attenuation coefficient, from or by the short-term power spectrum of a speech signal including the noise, and thereby estimating the power spectrum of the speech signal to suppress the noise. Examples of the spectral subtraction method are described in "S.Boll, Suppression of acoustic noise in speech using spectral subtraction, IEEE Trans.Acoustics, Speech, and Signal Processing, vol.ASSP-27, pp.113-120, 1979", "R. J. McAulay, M. L. Malpass, Speech enhancement using a soft-decision noise suppression filter, IEEE.Trans.Acoustics, Speech, and Signal Processing, vol-.ASSP-28, pp.137-145, 1980", Patent 2714656, and Japanese Patent Application HEI9-518820.

Meanwhile, the comb method is to attenuate a noise by applying a comb filter to a pitch of the speech spectrum. An example of the comb filtering is described in".

A comb filter is one which attenuates or does not attenuate a signal input per frequency region basis to output the signal, and which has comb-shaped attenuation characteristics. When the comb filtering method is achieved in digital data processing, data of attenuation characteristics is generated per frequency region basis from the attenuation characteristics of the comb filter, the data is multiplied by the speech spectrum for each frequency, and it is thereby possible to suppress the noise.

FIG. 1 is a diagram illustrating an example of a speech processing apparatus using a conventional comb filtering method. In FIG. 1, switch 11 outputs an input signal itself as an output of the apparatus when the input signal includes a speech component (for example, a consonant) without the quasi-periodicity, while outputting the input signal to comb filter 12 when the input signal includes a speech component with the quasi-periodicity. Comb filter 12 attenuates a noise portion of the input signal per frequency region basis with attenuation characteristics based on the information of speech pitch period, and outputs the resultant signal.

FIG. 2 is a graph showing attenuation characteristics of a comb filter. The vertical axis represents attenuation characteristics of a signal, and the horizontal axis represents frequency. As shown in FIG. 2, the comb filter has frequency regions in which a signal is attenuated and the other frequency regions in which a signal is not attenuated.

In the comb filtering method, by applying the comb filter to an input signal, the input signal is not attenuated in frequency regions in which a speech component exists, while being attenuated in frequency regions in which a speech component does not exists, and thereby a noise is suppressed to enhance the speech.

However, the conventional speech processing method has problems to be solved as described below. First, in the SS method as described in document 1, attention is only focused on the noise information, short-term noise characteristics are assumed as stationary, and a noise base (spectral characteristics of the estimated noise) is uniformly subtracted without distinguishing between a speech and noise. Speech information (for example, pitch of speech) is not used. Since the noise characteristics are not stationary actually, a residual noise remaining after the subtraction, in particular, residual noise between speech pitches is considered as a cause of generating a noise with an unnatural distortion so-called "musical noise" corresponding to the processing method.

As a method of improving the foregoing, a method is proposed of attenuating a noise by multiplying an attenuation coefficient based on a ratio of speech power to noise power (SNR), of which examples are described in Patent 2714656 and Japanese Patent Application HEI9-518820. In the method, since different attenuation coefficients are used while distinguishing between frequency bands of larger speech (large SNR) and of large noise (small SNR), the musical noise is suppressed and the speech quality is improved. However, in the methods described in Patent 2714656 and Japanese Patent Application HEI9-518820, since the number of frequency channels (16 channels) to be processed is not adequate even with part (SNR) of speech information used, it is difficult to separate speech pitch information from a noise to extract. Further, since the attenuation coefficient is used both in speech and noise frequency bands, effects are imposed mutually and the attenuation coefficient cannot be increased. In other words, the increased attenuation coefficient provides a possibility of generating a speech distortion due to erroneous SNR estimation. As a result, the attenuation of noise is not sufficient.

Further in the conventional comb filtering method, when a pitch that is a basic frequency has an estimation error, an error portion is enlarged in its harmonics, which increases a possibility that the original harmonics are out of the passband. Furthermore, since it is necessary to determine whether or not a speech is one with quasi-periodicity, the method has problems with practicability.

DISCLOSURE OF INVENTION

It is an object of the present invention to provide a speech processing apparatus and speech processing method enabling sufficient cancellation of noise with less speech distortions.

The object is achieved by identifying a speech spectrum as a region of speech component or region of no speech component per frequency region basis, generating a comb filter for enhancing only speech information in the frequency region based on a high-accuracy speech pitch obtained from the identification information, and thereby suppressing the noise.

BRIEF DESCRIPTION OF DRAWINGS

FIG. 22 is a view showing an example of a speech/noise determination program in the speech processing apparatus in the above embodiment;

BEST MODE FOR CARRYING OUT THE INVENTION

Embodiments of the present invention will be described below with reference to accompanying drawings.

First Embodiment

Figure 1:
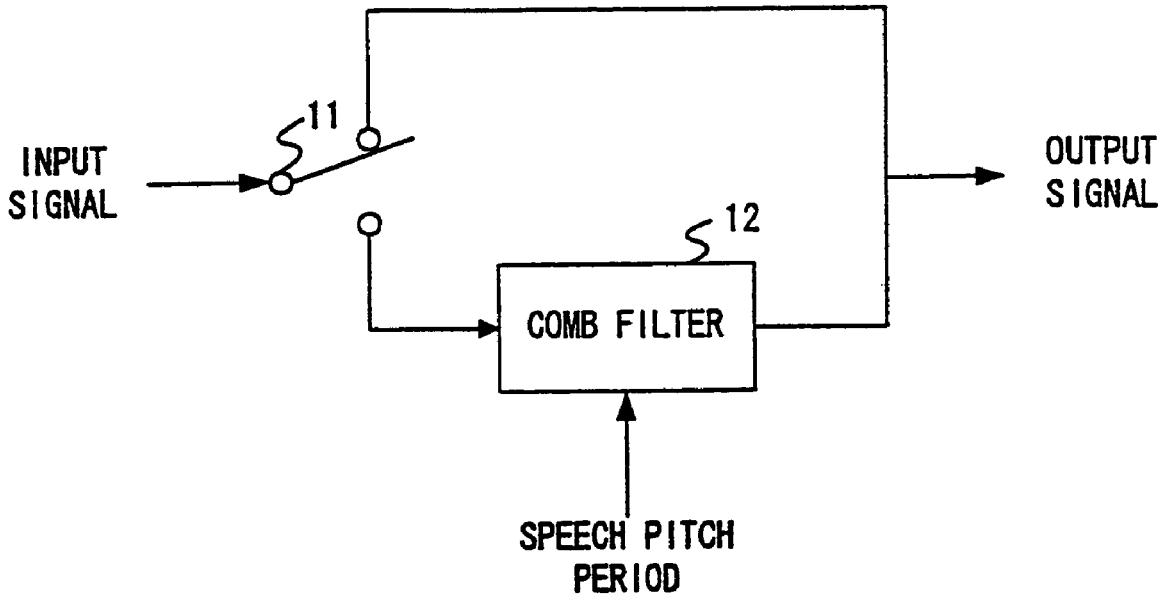
RELATED ART FIG.1
FIG. 1 is a diagram illustrating an example of a speech processing apparatus using a conventional comb filtering method.
Figure 2:
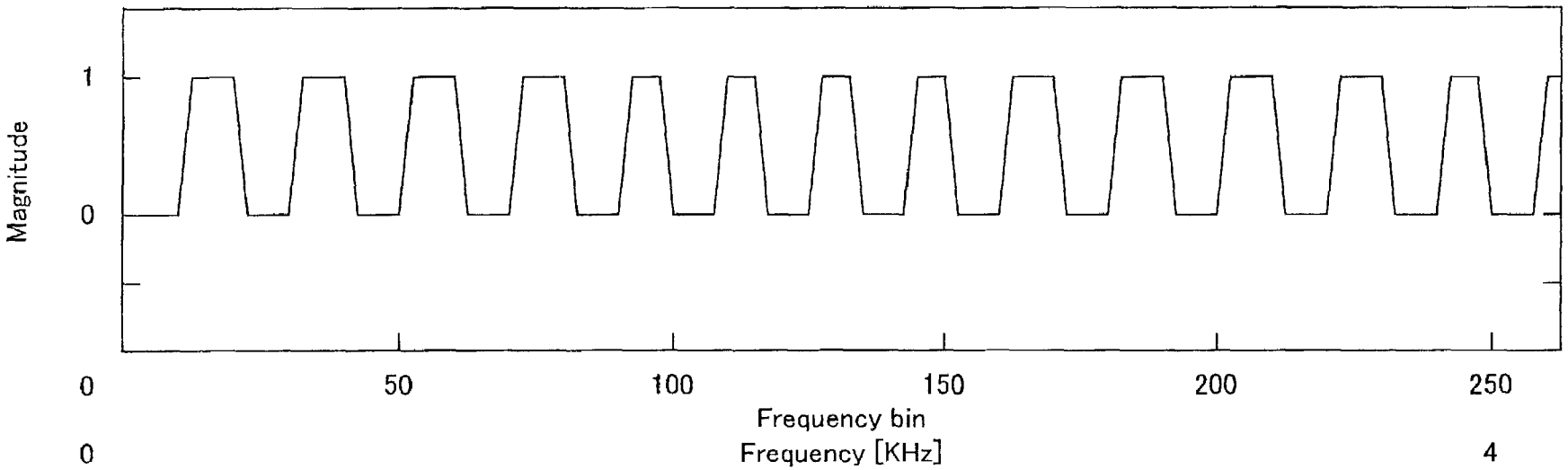
FIG. 2 is a graph showing attenuation characteristics of a comb filter.
Figure 3:
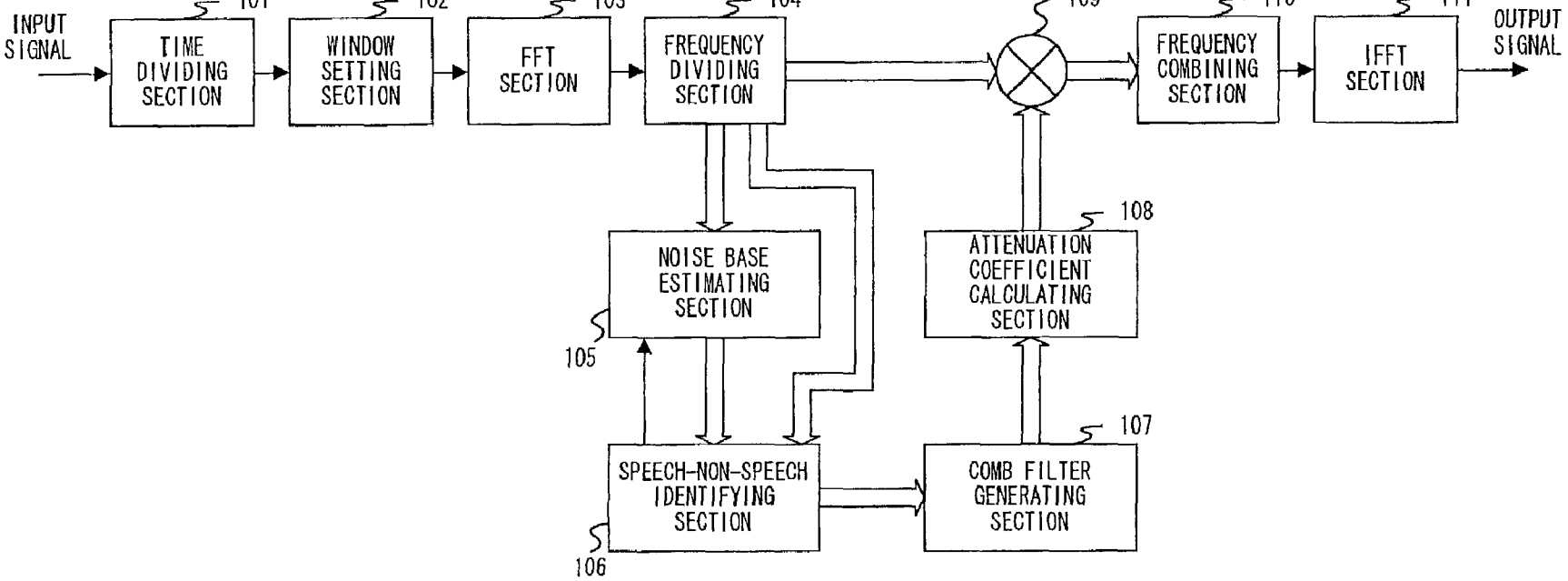
FIG. 3 is a block diagram illustrating a configuration of a speech processing apparatus according to Embodiment 1 of the present invention.

FIG. 3 is a block diagram illustrating a configuration of a speech processing apparatus according to Embodiment 1 of the present invention. In FIG. 3, the speech processing apparatus is primarily comprised of time dividing section 101, window setting section 102, FFT section 103, frequency dividing section 104, noise base estimating section 105, speech-non-speech identifying section 106, comb filter generating section 107, attenuation coefficient calculating section 108, multiplying section 109, frequency combining section 110 and IFFT section 111.

Time dividing section 101 configures a frame of predetermined unit time from an input speech signal to output to window setting section 102. Window setting section 102 performs window processing on the frame output from time dividing section 101 using a Hanning window to output to FFT section 103. FFT section 103 performs FFT (Fast Fourier Transform) on a speech signal output from window setting section 102, and outputs a speech spectral signal to frequency dividing section 104.

Frequency dividing section 104 divides the speech spectrum output from FFT section 103 into frequency components of predetermined unit frequency region, and outputs the speech spectrum for each frequency component to noise base estimating section 105, speech-non-speech identifying section 106 and multiplying section 109. In addition, the frequency component is indicative of the speech spectrum divided per predetermined frequencies basis.

Noise base estimating section 105 outputs a noise base previously estimated to speech-non-speech identifying section 106 when the section 106 outputs a determination indicating that the frame includes a speech component. Meanwhile, when speech-non-speech identifying section 106 outputs a determination indicating that the frame does not include a speech component, noise base estimating section 105 calculates the short-term power spectrum and a displacement average value indicative of an average value of variations in the spectrum for each frequency component of the speech spectrum output from frequency dividing section 104, further calculates a weighted average value of a previously calculated replacement average value and the power spectrum, and thereby calculates a new replacement average value.

Specifically, the section 105 estimates a noise base in each frequency component using equation (1) to output to speech-non-speech identifying section 106:

$$P_{base}(n,k)=(1-\alpha(k))\cdot P_{base}(n-1,k)+\alpha(k)\cdot S^2_f(n,k) \quad (1)$$

where n is a number for specifying a frame to be processed, k is a number for specifying a frequency component, and $S^2_f(n,k)$, $P_{base}(n,k)$ and $\alpha(k)$ respectively indicate power spectrum of an input speech signal, replacement average value of a noise base, and replacement average coefficient.

In the case where a difference is not less than a predetermined threshold between the speech spectral signal output from frequency dividing section 104 and a value of the noise base output from noise base estimating section 105, speech-non-speech identifying section 106 determines the signal as a speech portion including a speech component, while in the other case, determining the signal as a non-speech portion with only a noise and no speech component included. Then, speech-non-speech identifying section 106 outputs the determination to noise base estimating section 105 and comb filter generating section 107.

Based on the presence or absence of a speech component in each frequency component, comb filter generating section 107 generates a comb filter for enhancing pitch harmonics, and outputs the comb filter to attenuation coefficient calculating section 108. Specifically, comb filter generating section 107 makes the comb filter ON in a frequency component of speech portion, and OFF in a frequency component of non-speech portion.

Attenuation coefficient calculating section 108 multiplies the comb filter generated in comb filter generating section 107 by an attenuation coefficient based on the frequency characteristics, sets an attenuation coefficient of an input signal for each frequency component, and outputs the attenuation coefficient of each frequency component to multiplying section 109.

For example, it is possible to calculate attenuation coefficient gain(k) from following equation (2) to multiply by an input signal:

$$\text{gain}(k)=gc\cdot k/HB \quad (2)$$

where gc is a constant, k is a variable for specifying bin, HB is a transform length in FFT, i.e., the number of items of data in performing Fast Fourier Transform.

Multiplying section 109 multiplies the speech spectrum output from frequency dividing section 104 by the attenuation coefficient output from attenuation coefficient calculating section 108 per frequency component basis. Then, the section 109 outputs the spectrum resulting from the multiplication to frequency combining section 110.

Frequency combining section 110 combines spectra of frequency component basis output from multiplying section 109 to the speech spectrum continuous over a frequency region per predetermined unit time basis to output to IFFT section 111. IFFT section 111 performs IFFT (Inverse Fast Fourier Transform) on the speech spectrum output from frequency combining section 110, and outputs a transformed speech signal.

Figure 4:
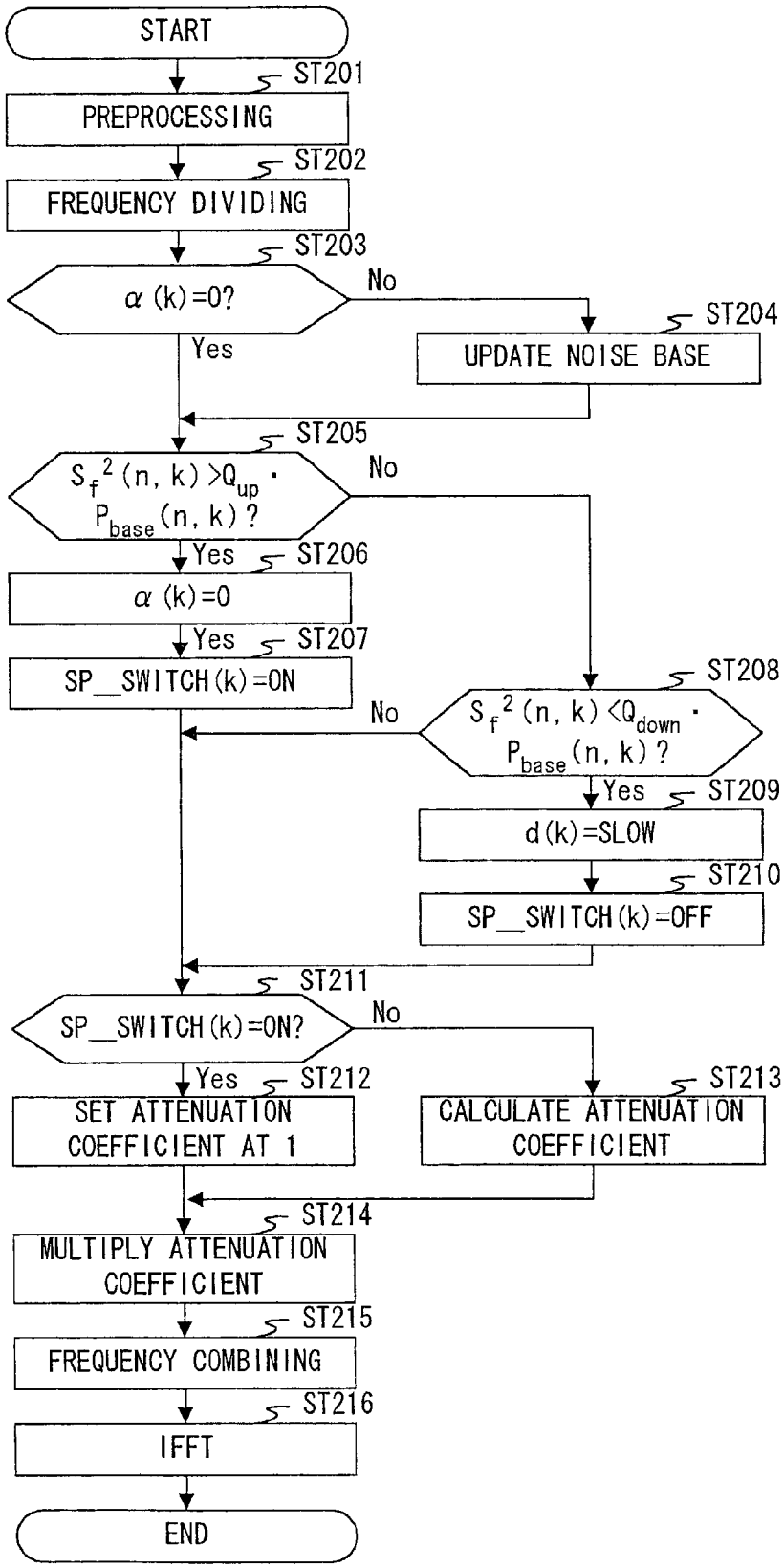
FIG. 4 is a flow diagram showing an operation of the speech processing apparatus in the above embodiment.

The operation of the speech processing apparatus with the above configuration will be described next with reference to a flow diagram illustrated in FIG. 4. In FIG. 4, in step (hereinafter referred to as "ST") 201, an input signal undergoes preprocessing. In this case, the preprocessing is to configure a frame of predetermined unit time from the input signal to perform window setting, and to perform FFT on the speech spectrum.

In ST202, frequency dividing section 104 divides the speech spectrum into frequency components. In ST203, noise base estimating section 105 determines whether $\alpha(k)$ is equal to 0 ($\alpha(k)=0$), i.e., whether to stop updating the noise base. The processing flow proceeds to ST205 when $\alpha(k)$ is equal to 0 ($\alpha(k)=0$), while proceeding to ST204 when whether $\alpha(k)$ is not equal to 0.

In ST204, noise base estimating section 105 updates the noise base from the speech spectrum with no speech component included therein, and the processing flow proceeds to ST205. In ST205, speech-non-speech identifying section 106 determines whether $S^2_f(n,k)$ is more than $Q_{up}\cdot P_{base}(n,K)$($S^2_f(n,k)>Q_{up}\cdot P_{base}(n,K)$), i.e., power of the speech spectrum is more than a value obtained by multiplying the noise base by a predetermined threshold. The processing flow proceeds to ST206 when $S^2_f(n,k)$ is more than $Q_{up}\cdot P_{base}(n,K)$($S^2_f(n,k)>Q_{up}\cdot P_{base}(n,K)$), while proceeding to ST208 when $S^2_f(n,k)$ is not more than $Q_{up}\cdot P_{base}(n,K)$.

In ST206, speech-non-speech identifying section 106 sets $\alpha(k)$ at 0 ($\alpha(k)=0$) indicative of stopping updating the noise base. In ST207, comb filter generating section 107 sets SP_SWITCH(k) at ON (SP_SWITCH(k)=ON) indicative of not attenuating the speech spectrum to output, and the processing flow proceeds to ST211. In ST208, speech-non-speech identifying section 106 determines whether $S^2_f(n,k)$ is less than $Q_{down}\cdot P_{base}(n,K)$ ($S^2_f(n,)<Q_{down}\cdot P_{base}(n,K)$), i.e., power of the speech spectrum is less than a value obtained by multiplying the noise base by a predetermined threshold. The processing flow proceeds to ST209 when $S^2_f(n,k)$ is less than $Q_{down}\cdot P_{base}(n,K)$($S^2_f(n,)<Q_{down}\cdot P_{base}(n,K)$), while proceeding to ST209 when $S^2_f(n,k)$ is not less than $Q_{down}\cdot P_{base}(n,K)$.

In ST209, speech-non-speech identifying section 106 sets $\alpha(k)$ at SLOW ($\alpha(k)$=SLOW) indicative of updating the noise base. "SLOW" is of a predetermined constant. In ST210, comb filter generating section 107 sets SP_SWITCH (k) at OFF (SP_SWITCH(k)=OFF) indicative of attenuating the speech spectrum to output, and the processing flow proceeds to ST211.

In ST211, attenuation coefficient calculating section 108 determines whether to attenuate the speech spectrum, i.e., whether SP_SWITCH(k) is ON (SP_SWITCH(k)=ON). When SP_SWITCH(k) is ON in ST211, in ST212 attenuation coefficient calculating section 108 sets an attenuation coefficient at 1, and the processing flow proceeds to ST214. When SP_SWITCH(k) is not ON in ST211, in ST213 attenuation coefficient calculating section 108 calculates an attenuation coefficient corresponding to frequency to set, and the processing flow proceeds to ST214.

In ST214 multiplying section 109 multiplies the speech spectrum output from frequency dividing section 104 by the attenuation coefficient output from attenuation factor calculating section 108 per frequency component basis. In ST215 frequency combining section 110 combines spectra of frequency component basis output from multiplying section 109 to the speech spectrum continuous over a frequency region per predetermined unit time basis. In ST216 IFFT section 111 performs IFFT on the speech spectrum output from frequency combining section 110, and outputs a signal with the noise suppressed.

Figure 5:
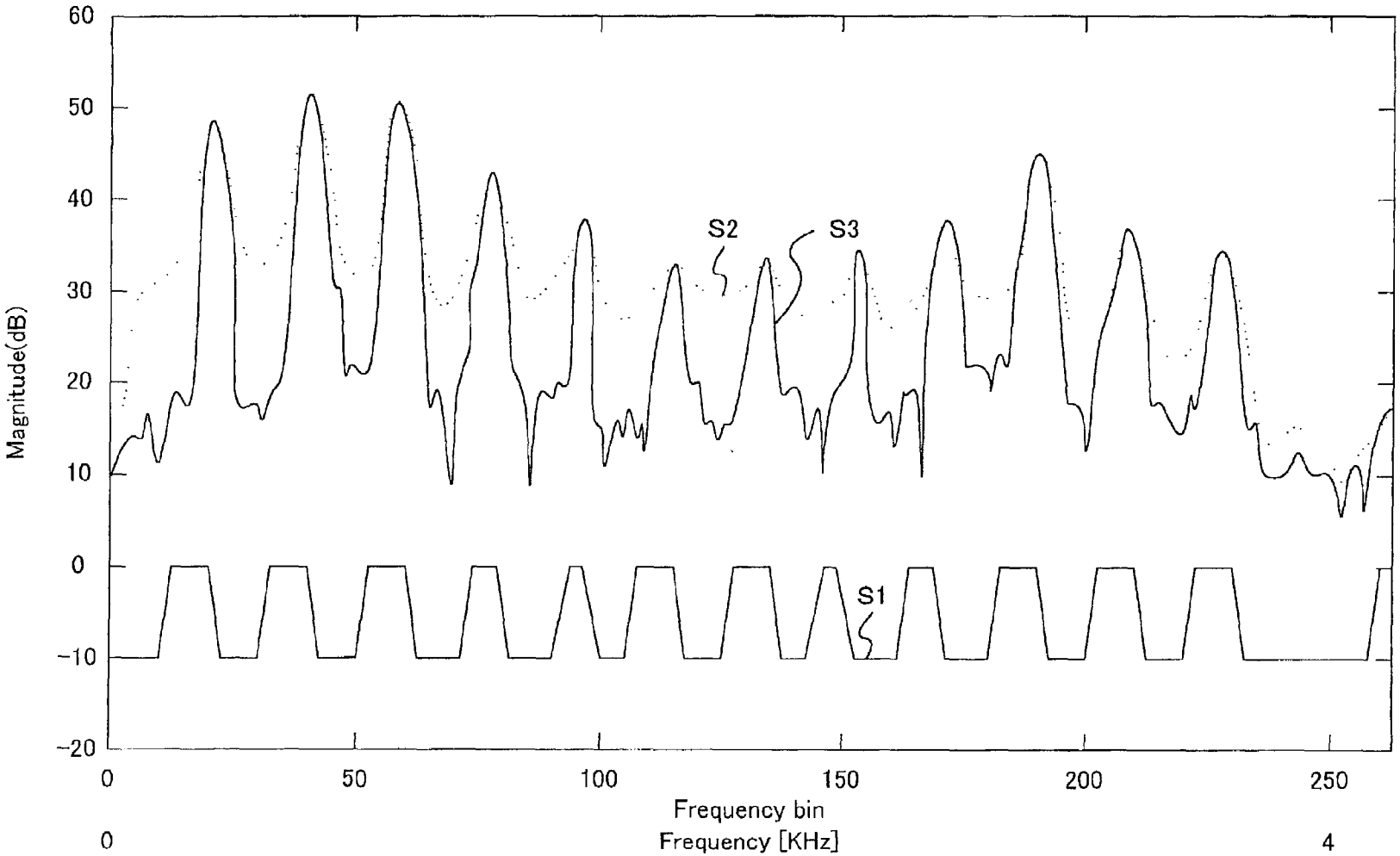
FIG. 5 is a diagram showing an example of a comb filter generated in the speech processing apparatus in the above embodiment.

The comb filter used in the speech processing apparatus of this embodiment will be described below. FIG. 5 is a graph showing an example of the comb filter generated in the speech processing apparatus according to this embodiment. In FIG. 5, the horizontal axis represents power of spectrum and attenuation degree of the filter, and the horizontal axis represents frequency.

The comb filter has attenuation characteristics indicated by S1, and the attenuation characteristics are set for each frequency component. Comb filter generating section 107 generates a comb filter for attenuating a signal of a frequency region including no speech component, while not attenuating a signal of a frequency region including a speech component.

By applying the comb filter having attenuation characteristics S1 to speech spectrum S2 including noise components, signals of frequency regions including noise components are attenuated and the power of the signals is decreased, while portions including speech signals are not attenuated and the power of the portions does not change. The obtained speech spectrum has a spectral shape with power of frequency regions of noise component lowered and peaks not lost but enhanced, and thereby speech spectrum S3 is output in which pitch harmonic information is not lost and noises are suppressed.

Thus, according to the speech processing apparatus according to Embodiment 1 of the present invention, a speech interval or non-speech interval of a spectral signal is determined per frequency component basis, and the signal is attenuated per frequency component basis with attenuation characteristics based on the determination. It is thereby possible to obtain accurate pitch information and to perform speech enhancement with less speech distortions even when noise suppression is performed with large attenuation.

Further, setting two thresholds in identifying a speech enables highly accurate speech-non-speech determination.

In addition, it may be possible that attenuation coefficient calculating section 108 calculates an attenuation coefficient corresponding to frequency characteristics of noise so as to enable speech enhancement without degrading consonants in high frequencies.

Further, it may be possible to attenuate an input signal in each frequency component using two values, so as to attenuate the signal determined as a noise, while not attenuating the signal determined as a speech. In this case, since frequency components including a speech are not attenuated even when strong noise suppression is performed, it is possible to perform speech enhancement with less speech distortions.

Embodiment 2

Figure 6:
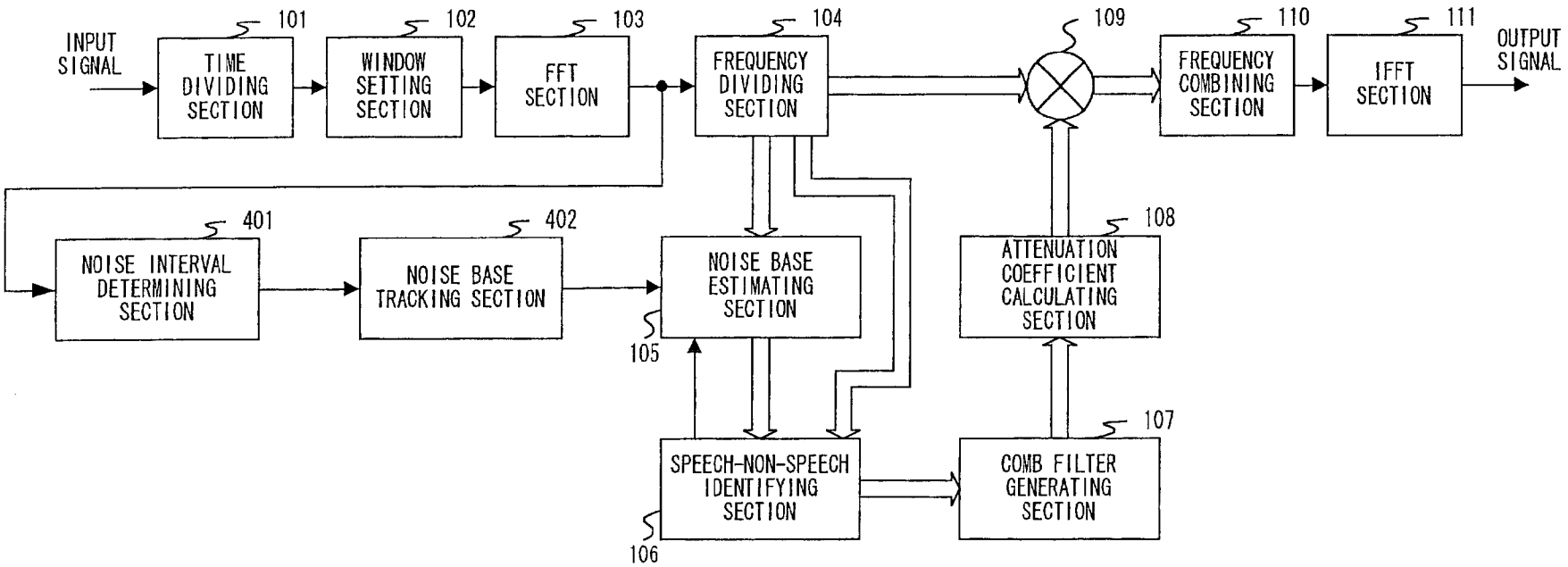
FIG. 6 is a block diagram illustrating an example of a configuration of a speech processing apparatus according to Embodiment 2.

FIG. 6 is a block diagram illustrating an example of a configuration of a speech processing apparatus according to Embodiment 2. In addition, in FIG. 6 sections common to FIG. 3 are assigned the same reference numerals as in FIG. 3 to omit specific descriptions.

The speech processing apparatus in FIG. 6 is provided with noise interval determining section 401 and noise base tracking section 402, makes a speech-non-speech determination of a signal per frame basis, detects a rapid change in noise level, estimates the noise base promptly to update, and in this respect, differs from the apparatus in FIG. 3.

In FIG. 6 FFT section 103 performs FFT (Fast Fourier Transform) on a speech signal output from window setting section 102, and outputs a speech spectrum to frequency dividing section 104 and noise interval determining section 401.

Noise interval determining section 401 calculates power of the signal and replacement average value per frame basis from the speech spectrum output from FFT section 103, and determines whether or not a frame includes a speech from the change rate of power of the input signal.

Specifically, noise interval determining section 401 calculates a change rate of the power of an input signal using following equations (3) and (4):

$$P(n) = \sum_{k=0}^{Hb/2} S_f^2(n, k) \tag{3}$$

$$\text{Ratio} = P(n-\tau)/P(n) \tag{4}$$

where P(n) is signal power of a frame, $S^2_f(n,k)$ is an input signal power spectrum, "Ratio" is a signal power ratio of a frame previously processed to a frame to be processed, and $\tau$ is a delay time.

When "Ratio" exceeds a predetermined threshold successively during a predetermined period of time, noise interval determining section 401 determines an input signal as a speech signal, while determining an input signal as a signal of noise interval when "Ratio" does not exceed the threshold successively.

When it is determined the signal shifts from a speech interval to a noise interval, noise base tracking section 402 increases a degree of effect of estimating a noise base from processed frames in updating the noise base, during a period of time a predetermined number of frames are processed.

Specifically, in equation (1), $\alpha(k)$ is set at FAST ($\alpha(k)$ =FAST, 0<SLOW<FAST<1). As a value of $\alpha(k)$ is increased, a replacement average value tends to be more affected by an input speech signal, and it is possible to response to a rapid change in noise base.

When speech-non-speech identifying section 106 or noise base tracking section 402 outputs a determination indicating that a frame does not include a speech component, noise base estimating section 105 calculates the short-term power spectrum and a displacement average value indicative of an average value of variations in the spectrum for each frequency component of the speech spectrum output from frequency dividing section 104, and using these values, estimates a noise base in each frequency component to output to speech-non-speech identifying section 106.

Thus, according to the speech processing apparatus according to Embodiment 2 of the present invention, since the noise base is updated while greatly reflecting a value of a noise spectrum estimated from an input signal, it is possible to update the noise base coping with a rapid change in noise level, and to perform speech enhancement with less speech distortions.

Embodiment 3

Figure 7:
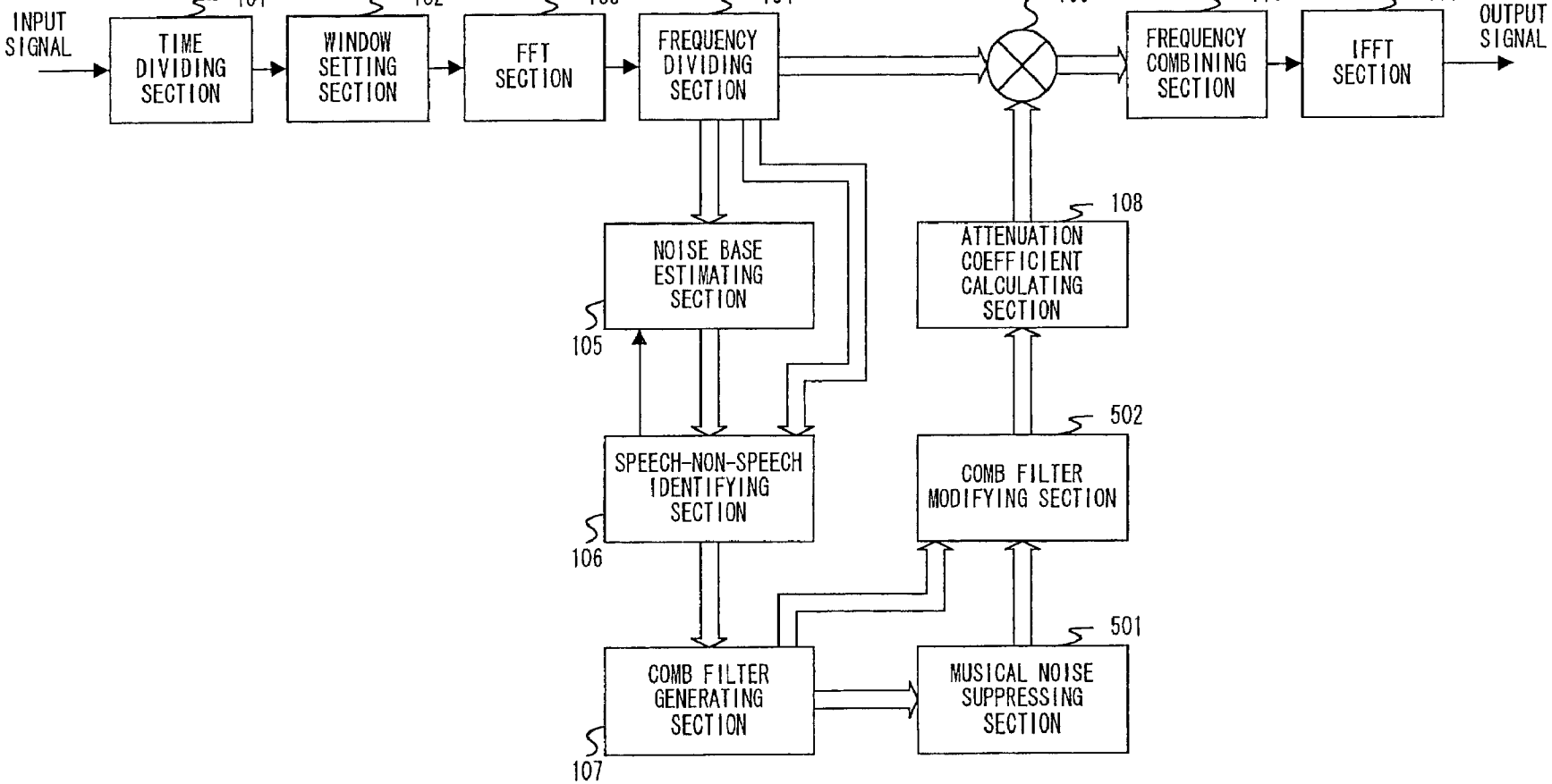
FIG. 7 is a block diagram illustrating an example of a configuration of a speech processing apparatus according to Embodiment 3.

FIG. 7 is a block diagram illustrating an example of a configuration of a speech processing apparatus according to Embodiment 3. In addition, in FIG. 7 sections common to FIG. 3 are assigned the same reference numerals as in FIG. 3 to omit specific descriptions.

The speech processing apparatus in FIG. 7 is provided with musical noise suppressing section 501 and comb filter modifying section 502, suppresses an occurrence of a musical noise caused by a sudden noise by modifying a generated comb filter when a frame includes the sudden noise, and in this respect, differs from the apparatus in FIG. 3.

In FIG. 7, based on the presence or absence of a speech component in each frequency component, comb filter generating section 107 generates a comb filter for enhancing pitch harmonics, and outputs the comb filter to musical noise suppressing section 501 and comb filter modifying section 502.

When the number of "ON" states of frequency components of the comb filter output from comb filter generating section 107, i.e., the number of states where a signal is output without being attenuated, is not more than a predetermined threshold, musical noise suppressing section 501 determines that a frame includes a sudden noise, and outputs a determination to comb filter modifying section 502.

For example, the number of "ON" frequency components in the comb filter is calculated using following equation (5), and it is determined that a musical noise occurs when COMB_SUM(n) is less than a predetermined threshold (for example, 10):

$$\mathrm{COMB_SUM}(n) = \sum_{k=0}^{HB/2} \mathrm{COMB_ON}(n, k) \tag{5}$$

Based on the determination that the frame includes a sudden noise, output from musical noise suppressing section 501, determined based on a generation result of the comb filter output from comb filter generating section 107, comb filter modifying section 502 performs modification for preventing an occurrence of musical noise on the comb filter, and outputs the comb filter to attenuation coefficient calculating section 108.

Specifically, the section 502 sets all the states of frequency components of the comb filter at "OFF", i.e., a state of attenuating the signal to output, and outputs the comb filter to attenuation coefficient calculating section 108.

Attenuation coefficient calculating section 108 multiplies the comb filter output from comb filter modifying section 502 by an attenuation coefficient based on the frequency characteristics, sets an attenuation coefficient of an input signal for each frequency component, and outputs the attenuation coefficient of each frequency component to multiplying section 109.

Thus, according to the speech processing apparatus according to Embodiment 3 of the present invention, whether a musical noise arises is determined from a generation result of the comb filter, and it is thereby possible to prevent a noise from being mistaken for a speech signal and to perform speech enhancement with less speech distortions.

Further, Embodiment 3 is capable of being combined with Embodiment 2. That is, it is possible to obtain the effectiveness of Embodiment 2 also by adding noise interval determing section 401 and noise base tracking section 402 to the speech processing apparatus in FIG. 7.

Embodiment 4

Figure 8:
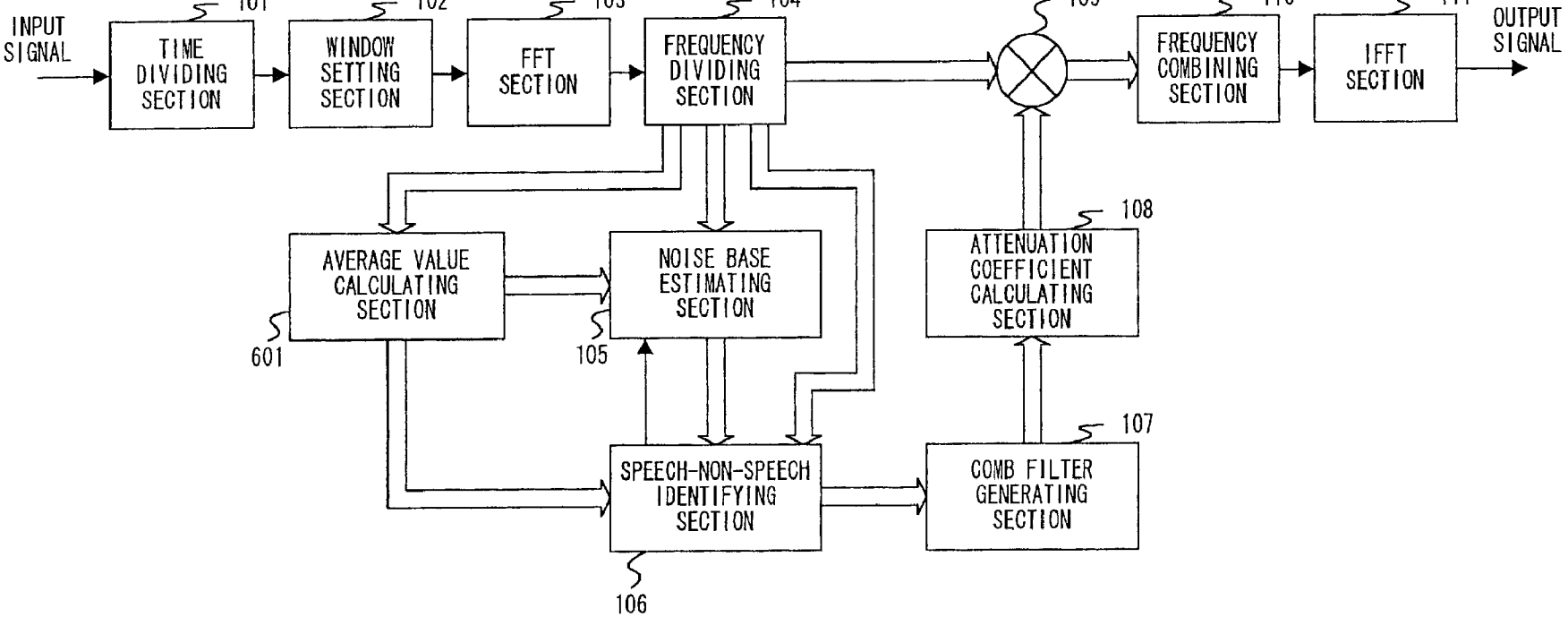
FIG. 8 is a block diagram illustrating an example of a configuration of a speech processing apparatus according to Embodiment 4.

FIG. 8 is a block diagram illustrating an example of a configuration of a speech processing apparatus according to Embodiment 4. In addition, in FIG. 8 sections common to FIG. 3 are assigned the same reference numerals as in FIG. 3 to omit specific descriptions. The speech processing apparatus in FIG. 8 is provided with average value calculating section 601, obtains an average value of power of speech spectrum per frequency component basis, and in this respect, differs from the apparatus in FIG. 3.

In FIG. 8, frequency dividing section 104 divides the speech spectrum output from FFT section 103 into frequency components indicative of a speech spectrum divided per predetermined frequencies basis, and outputs the speech spectrum for each frequency component to speech-non-speech identifying section 106, multiplying section 109 and average value calculating section 601.

With respect to power of the speech spectrum output from frequency dividing section 104, average value calculating section 601 calculates an average value of such power and peripheral frequency components and an average value of such power and previously processed frames, and outputs the obtained average values to noise base estimating section 105 and speech-non-speech identifying section 106.

Specifically, an average value of speech spectra is calculated using equation (6) indicated below:

$$\sum S_f^2(n, k) = \sum_{i=n1}^{n} \sum_{j=k1}^{k2} S_f^2(i, j) \tag{6}$$

where k1 and k2 indicate frequency components and k1<k<k2, n1 is a number indicating a frame previously processed, and n is a number indicating a frame to be processed.

When speech-non-speech identifying section 106 outputs a determination indicating that a frame does not include a speech component, noise base estimating section 105 calculates the short-term power spectrum and a displacement average value indicative of an average value of variations in the spectrum for each frequency component of an average value of the speech spectrum output from average value calculating section 601, and thereby estimates a noise base in each frequency component to output to speech-non-speech identifying section 106.

Speech-non-speech identifying section 106 determines the signal as a speech portion including a speech component in the case where a difference is not less than a predetermined threshold between the average value of the speech spectral signal output from average value calculating section 601 and a value of the noise base output from noise base estimating section 105, while determining the signal as a non-speech portion with only a noise and no speech component included in the other cases. Then, the section 106 outputs the determination to noise base estimating section 105 and comb filter generating section 107.

Thus, according to the speech processing apparatus according to Embodiment 4 of the present invention, a power average value of speech spectrum or power average values of previously processed frames and of frames to be processed are obtained for each frequency component, and it is thereby possible to decrease adverse effects of a sudden noise component, and to construct a more accurate comb filter.

In addition, Embodiment 4 is capable of being combined with Embodiment 2 or 3. That is, it is possible to obtain the effectiveness of Embodiment 2 also by adding noise interval determing section 401 and noise base tracking section 402 to the speech processing apparatus in FIG. 8, and to obtain the effectiveness of Embodiment 3 also by adding musical noise suppressing section 501 and comb filter modifying section 502 to the speech processing apparatus in FIG. 8.

Embodiment 5

Figure 9:
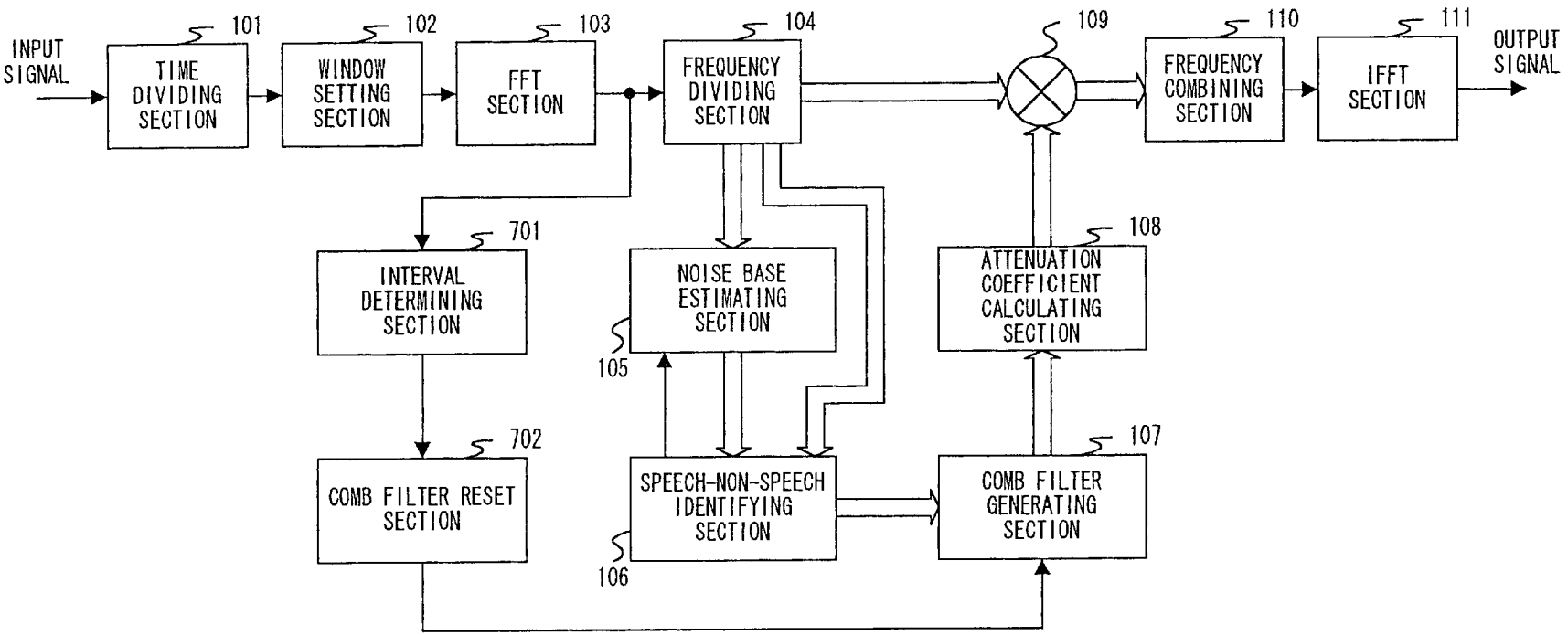
FIG. 9 is a block diagram illustrating an example of a configuration of a speech processing apparatus according to Embodiment 5.

FIG. 9 is a block diagram illustrating an example of a configuration of a speech processing apparatus according to Embodiment 5. In addition, in FIG. 9 sections common to FIG. 3 are assigned the same reference numerals as in FIG. 3 to omit specific descriptions.

The speech processing apparatus in FIG. 9 is provided with interval determining section 701 and comb filter reset section 702, generates a comb filter for attenuating all frequency components in a frame with no speech component included, and in this respect, differs from the apparatus in FIG. 3.

In FIG. 9, FFT section 103 performs FFT on a speech signal output from window setting section 102, and outputs a speech spectral signal to frequency dividing section 104 and interval determining section 701.

Interval determining section 701 determines whether or not the speech spectrum output from FFT section 103 includes a speech, and outputs a determination to comb filter reset section 702.

When it is determined that the speech spectrum is of only a noise component without including a speech component based on the determination output from interval determining section 701, comb filter reset section 702 outputs an instruction for making all the frequency components of the comb filter "OFF" to comb filter generating section 107.

Comb filter generating section 107 generates a comb filter for enhancing pitch harmonics based on the presence or absence of a speech component in each frequency component to output to attenuation coefficient calculating section 108. Meanwhile, when it is determined that the speech spectrum is of only a noise component without including a speech component, according to the instruction of comb filter reset section 702, comb filter generating section 107 generates a comb filter with OFF in all the frequency components to output to attenuation coefficient calculating section 108.

In this way, according to the speech processing apparatus according to Embodiment 5 of the present invention, a frame including no speech component is subjected to the attenuation in all the frequency components, thereby the noise is cut in the entire frequency band at a signal interval including no speech, and it is thus possible to prevent an occurrence of noise caused by speech suppressing processing. As a result, it is possible to perform speech enhancement with less speech distortions.

In addition, Embodiment 5 is capable of being combined with Embodiment 2 or 3.

That is, it is possible to obtain the effectiveness of Embodiment 2 also by adding noise interval determining section 401 and noise base tracking section 402 to the speech processing apparatus in FIG. 9, and to obtain the effectiveness of Embodiment 3 also by adding musical noise suppressing section 501 and comb filter modifying section 502 to the speech processing apparatus in FIG. 9.

Further, Embodiment 5 is capable of being combined with Embodiment 4. That is, it is possible to obtain the effectiveness of Embodiment 4 also by adding average value calculating section 601 to the speech processing apparatus in FIG. 9.

In this case, frequency dividing section 104 divides the speech spectrum output from FFT section 103 signal into frequency components each indicative of a speech spectrum divided per predetermined frequencies basis, and outputs the speech spectrum for each frequency component to speech-non-speech identifying section 106 and multiplying section 109, and average value calculating section 601.

Speech-non-speech identifying section 106 determines the signal as a speech portion including a speech component in the case where a difference is not less than a predetermined threshold between the average value of the speech spectral signal output from average value calculating section 601 and a value of the noise base output from noise base estimating section 105, while determining the signal as a non-speech portion with only a noise and no speech component included in the other case. Then, the section 106 outputs the determination to noise base estimating section 105 and comb filter generating section 107.

Embodiment 6

Figure 10:
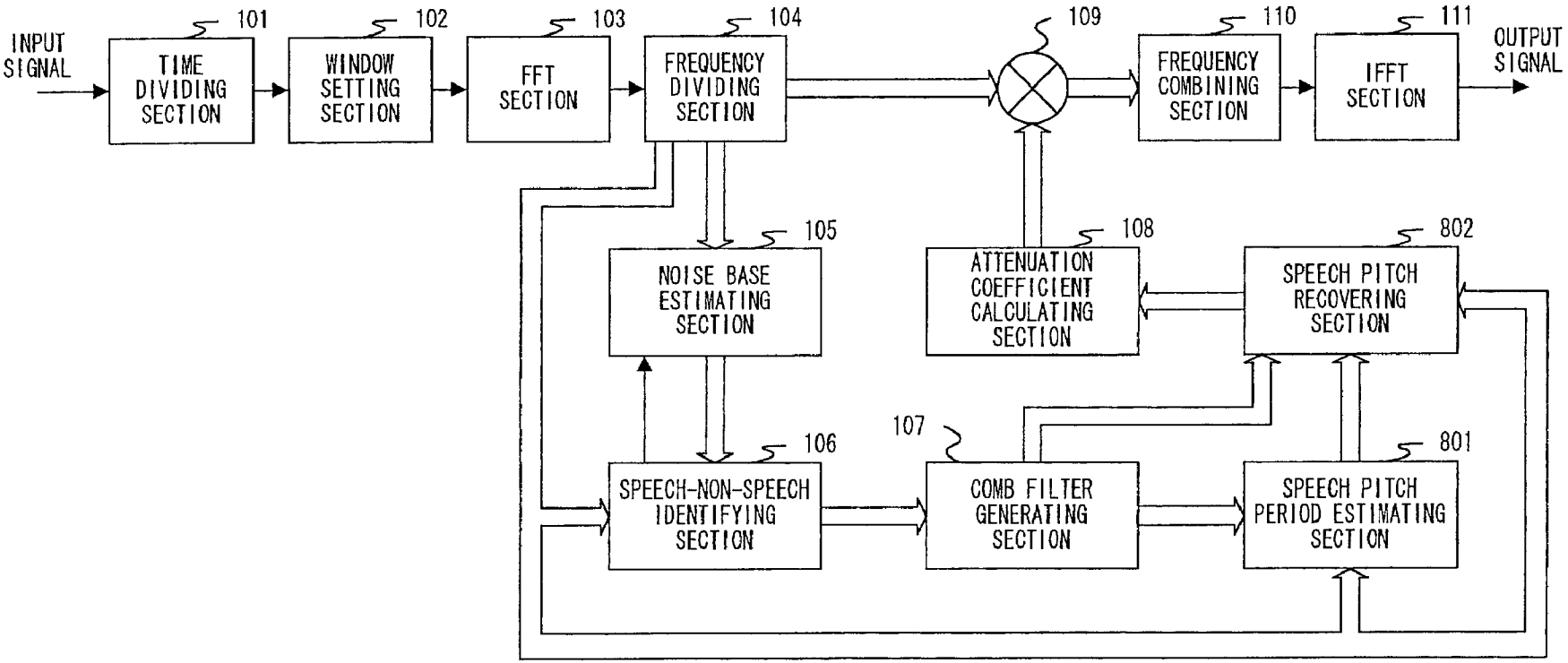
FIG. 10 is a block diagram illustrating an example of a configuration of a speech processing apparatus according to Embodiment 6.

FIG. 10 is a block diagram illustrating an example of a configuration of a speech processing apparatus according to Embodiment 6. In addition, in FIG. 10 sections common to FIG. 3 are assigned the same reference numerals as in FIG. 3 to omit specific descriptions.

The speech processing apparatus in FIG. 10 is provided with speech pitch period estimating section 801 and speech pitch recovering section 802, recovers pitch harmonic information that is determined to be a noise and lost in a frequency region in which the determination of a speech or noise is difficult, and in this respect, differs from the apparatus in FIG. 3.

In FIG. 10, frequency dividing section 104 divides the speech spectrum output from FFT section 103 into frequency components indicative of a speech spectrum divided per predetermined frequencies basis, and outputs the speech spectrum for each frequency component to noise base estimating section 105, speech-non-speech identifying section 106, multiplying section 109, speech pitch period estimating section 801 and speech pitch recovering section 802.

Comb filter generating section 107 generates a comb filter for enhancing pitch harmonics based on the presence or absence of a speech component in each frequency component to output to speech pitch period estimating section 801 and speech pitch recovering section 802.

Speech pitch period estimating section 801 estimates a pitch period from the comb filter output from comb filter generating section 107 and the speech spectrum output from frequency dividing section 104, and outputs an estimation to speech pitch recovering section 802.

For example, one frequency component is made OFF so as to prevent ON states from occurring successively in the generated comb filter. Then, two frequency components with large power are extracted from the comb filter so as to generate a comb filter for estimating a pitch period, and the pitch period is obtained from equation (7) of auto-correlation function described below:

$$\gamma(\tau) = \sum_{k=0}^{k1} PITCH(k) \cdot PITCH(k+\gamma) \tag{7}$$

where PITCH(k) is indicative of a state of the comb filter for estimating a pitch period, k1 indicates an upper limit of frequency, and $\tau$ indicates a period of a pitch and regions from 0 to $\tau 1$ that is the maximum period.

$\tau$ that maximizes $\gamma(\tau)$ of equation (7) is obtained as a pitch period. Since a shape of a frequency pitch tends to be unclear actually in high frequencies, an intermediate frequency value is used as a value of k. For example, k1 is set at 2 kHz (k1=2 kHz). Further, setting PITCH(k) at 0 or 1 simplifies the calculation of equation (7).

Speech pitch recovering section 802 compensates the comb filter based on the estimation output from speech pitch period estimating section 801 to output to attenuation coefficient calculating section 108. Specifically, the section 802 compensates for the pitch for each predetermined component based on the estimated pitch period information, or performs the processing for extending a width of a frequency band in the form of a comb representing successive frequency components of ON of the comb filter existing for each pitch period, and thereby recovers a pitch harmonic structure.

Attenuation coefficient calculating section 108 multiplies the comb filter output from speech pitch recovering section 802 by an attenuation coefficient based on the frequency characteristics, sets an attenuation coefficient of an input signal for each frequency component, and outputs the attenuation coefficient of each frequency component to multiplying section 109.

Figure 11:
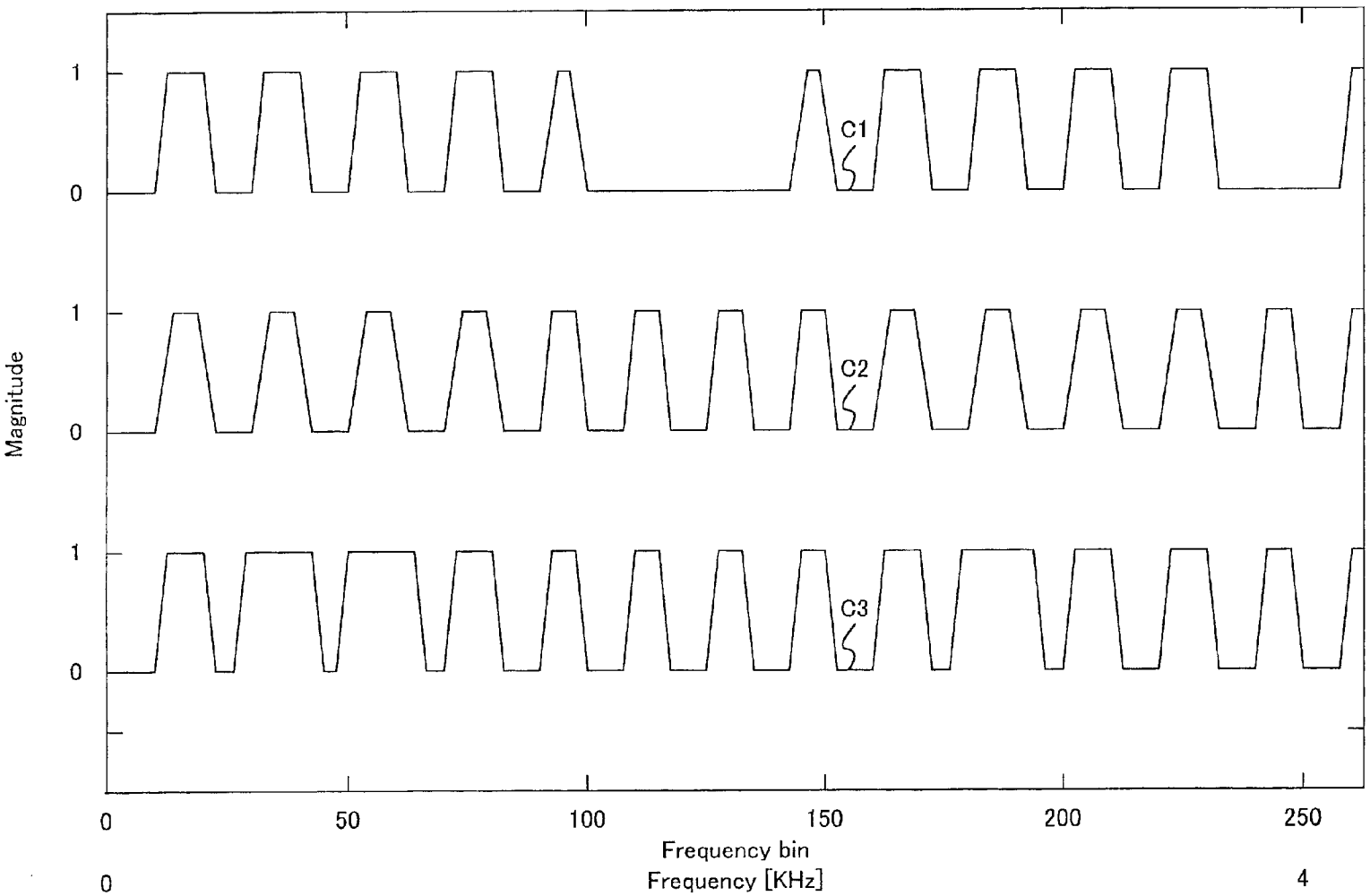
FIG. 11 is a graph showing an example of recovery of a comb filter in the speech processing apparatus in the above embodiment.

FIG. 11 illustrates an example of recovery in the comb filter in the speech processing apparatus according to this embodiment. In FIG. 11, the vertical axis represents attenuation degree of the filter, and the horizontal axis represents frequency component. Specifically, 256 frequency components are on the horizontal axis indicating a region ranging from 0 kHZ to 4 kHZ.

C1 indicates the generated comb filter, C2 indicates the comb filter obtained by performing the pitch recovery on comb filter C1, and C3 indicates the comb filter obtained by performing the pitch width compensation on comb filter C2.

Pitch information in frequency components 100 to 140 are lost in comb filter C1. Speech pitch recovering section 802 recovers the pitch information in frequency components 100 to 140 of comb filter C1 based on the pitch period information estimated in speech pitch period estimating section 801. Comb filter C2 is thus obtained.

Next, speech pitch recovering section 802 compensates for a width of a pitch harmonic of comb filter C2 based on the speech spectrum output from frequency dividing section 104. Comb filter C3 is thus obtained.

In this way, according to the speech processing apparatus according to Embodiment 6 of the present invention, pitch period information is estimated and pitch harmonic information is recovered. It is thereby possible to perform speech enhancement with a speech similar to the original speech and with less speech distortions.

Further, Embodiment 6 is capable of being combined with Embodiment 2 or 5.

That is, it is possible to obtain the effectiveness of Embodiment 2 also by adding noise interval determing section 401 and noise base tracking section 402 to the speech processing apparatus in FIG. 10, and to obtain the effectiveness of Embodiment 5 by adding interval determining section 701 and comb filter reset section 702 to the speech processing apparatus in FIG. 10.

Further, Embodiment 6 is capable of being combined with Embodiment 3. That is, it is possible to obtain the effectiveness of Embodiment 3 also by adding musical noise suppressing section 501 and comb filter modifying section 502 to the speech processing apparatus in FIG. 10.

In this case, when the number of "ON" states of frequency components of the comb filter output from comb filter generating section 107, i.e., the number of states where a signal is output without being attenuated, is not more than a predetermined threshold, musical noise suppressing section 501 determines that a frame includes a sudden noise, and outputs a determination to speech pitch period estimating section 801.

Based on the determination that the frame includes a sudden noise, output from speech pitch recovering section 802, determined based on a generation result of the comb filter output from comb filter generating section 107, comb filter modifying section 502 performs modification for preventing an occurrence of musical noise on the comb filter, and outputs the comb filter to attenuation coefficient calculating section 108.

Further, Embodiment 6 is capable of being combined with Embodiment 4. That is, it is possible to obtain the effectiveness of Embodiment 4 also by adding average value calculating section 601 to the speech processing apparatus in FIG. 10.

In this case, frequency dividing section 104 divides the speech spectrum output from FFT section 103 signal into frequency components each indicative of a speech spectrum divided per predetermined frequencies basis, and outputs the speech spectrum for each frequency component to speech-non-speech identifying section 106, multiplying section 109, and average value calculating section 601.

Speech-non-speech identifying section 106 determines the signal as a speech portion including a speech component in the case where a difference is not less than a predetermined threshold between the average value of the speech spectral signal output from average value calculating section 601 and a value of the noise base output from noise base estimating section 105, while determining the signal as a non-speech portion with only a noise and no speech component included in the other case. Then, the section 106 outputs the determination to noise base estimating section 105 and comb filter generating section 107.

Embodiment 7

Figure 12:
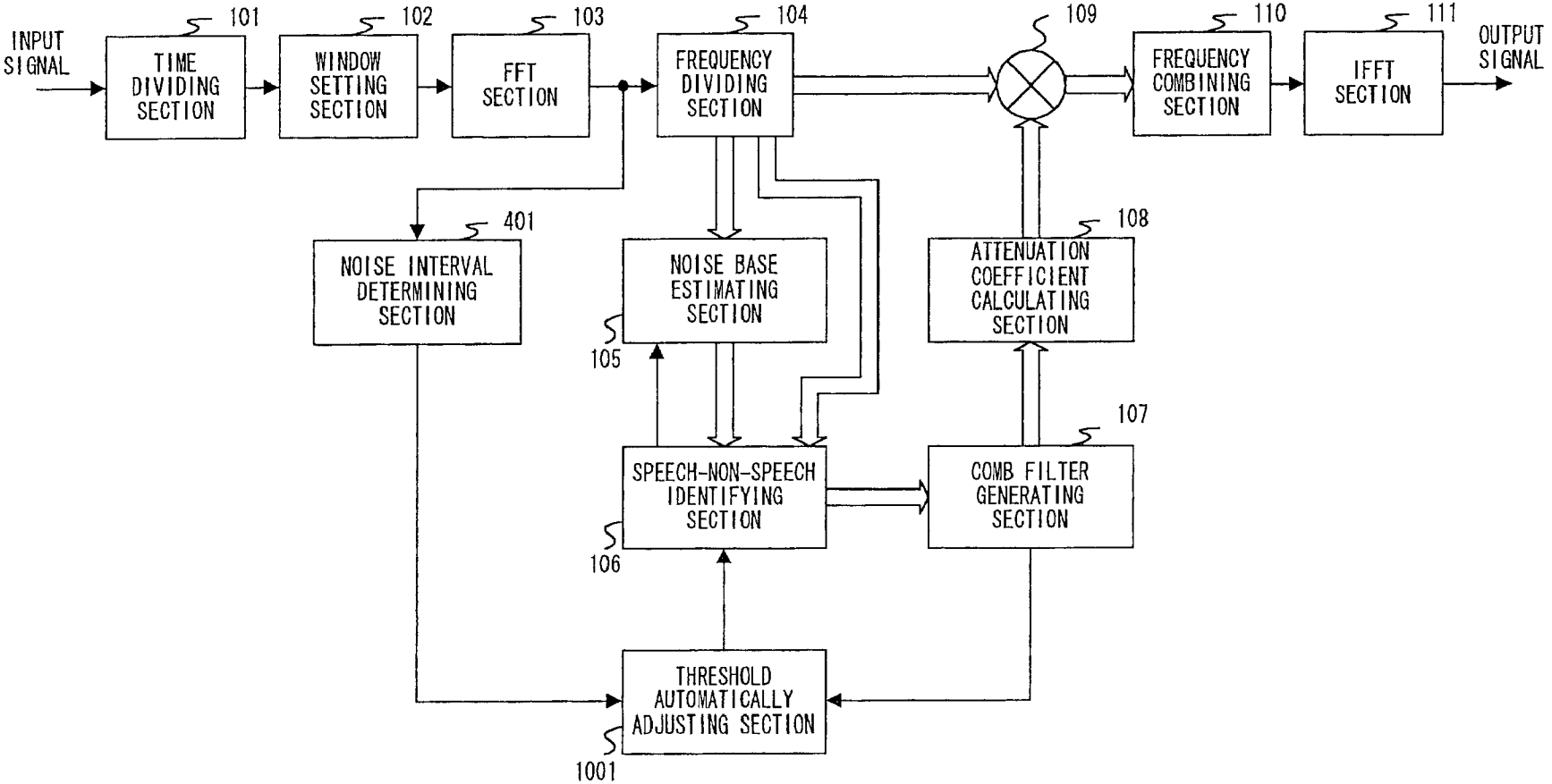
FIG. 12 is a block diagram illustrating an example of a configuration of a speech processing apparatus according to Embodiment 7.

FIG. 12 is a block diagram illustrating an example of a configuration of a speech processing apparatus according to Embodiment 7. In addition, in FIG. 12 sections common to FIG. 3 and FIG. 6 are assigned the same reference numerals as in FIG. 3 and FIG. 6 to omit specific descriptions. The speech processing apparatus in FIG. 12 is provided with threshold automatically adjusting section 1001, adjusts a threshold for speech identification corresponding to type of noise, and in this respect, differs from the apparatus in FIG. 3 or FIG. 6.

In FIG. 12, comb filter generating section 107 generates a comb filter for enhancing pitch harmonics based on the presence or absence of a speech component in each frequency component to output to threshold automatically adjusting section 1001.

Noise interval determining section 401 calculates power of the signal and replacement average value per frame basis from the speech spectrum output from FFT section 103, determines whether or not a frame includes a speech from the change rate of power of the input signal, and outputs a determination to threshold automatically adjusting section 1001.

When the determination output from noise interval determining section 401 indicates the frame does not include a speech signal, threshold automatically adjusting section 1001 changes the threshold in speech-non-speech identifying section 106 based on the comb filter output from comb filter generating section 107.

Specifically, the section 1001 calculates a summation of the number of frequency components of "ON" in the generated comb filter, using following equation (8):

$$\sum \text{COMB_SUM} = \sum_{n=n1}^{n2} \sum_{k=0}^{HB/2} \text{COMB_ON}(n, k) \tag{8}$$

The section 1001 outputs an instruction for increasing the threshold in speech-non-speech identifying section 106 to the section 106 when the summation is greater than a predetermined upper limit, while outputting an instruction for decreasing the threshold in the section 106 to the section 106 when the summation is smaller than a predetermined threshold.

Herein, n1 is a number for specifying a frame previously processed, and n2 is a number for specifying a frame to be processed.

For example, the section 1001 sets the threshold for speech-non-speech identification at a low level when a frame includes a noise with a small variation in its amplitude, while setting such a threshed at a high level when a frame includes a noise with a large variation in its amplitude.

Thus, according to the speech processing apparatus according to this embodiment of the present invention, based on the number of frequency components mistaken for components including a speech in a frame with no speech included therein, a threshold used for speech-non-speech identification of speech spectrum is varied, and it is thereby possible to make a determination on speech corresponding to type of noise and to perform speech enhancement with less speech distortions.

In addition, Embodiment 7 is capable of being combined with Embodiment 2 or 3.

That is, it is possible to obtain the effectiveness of Embodiment 2 also by adding noise interval determing section 401 and noise base tracking section 402 to the speech processing apparatus in FIG. 12, and to obtain the effectiveness of Embodiment 3 also by adding musical noise suppressing section 501 and comb filter modifying section 502 to the speech processing apparatus in FIG. 12.

Further, Embodiment 7 is capable of being combined with Embodiment 4. That is, it is possible to obtain the effectiveness of Embodiment 4 also by adding average value calculating section 601 to the speech processing apparatus in FIG. 12.

In this case, frequency dividing section 104 divides the speech spectrum output from FFT section 103 signal into frequency components each indicative of a speech spectrum divided per predetermined frequencies basis, and outputs the speech spectrum for each frequency component to speech-non-speech identifying section 106 multiplying section 109, and average value calculating section 601.

Speech-non-speech identifying section 106 determines the signal as a speech portion including a speech component in the case where a difference is not less than a predetermined threshold between the average value of the speech spectral signal output from average value calculating section 601 and a value of the noise base output from noise base estimating section 105, while determining the signal as a non-speech portion with only a noise and no speech component included in the other case. Then, the section 106 outputs the determination to noise base estimating section 105 and comb filter generating section 107.

Further, Embodiment 7 is capable of being combined with Embodiment 5 or 6. That is, it is possible to obtain the effectiveness of Embodiment 5 by adding interval determining section 701 and comb filter reset section 702 to the speech processing apparatus in FIG. 12, and to obtain the effectiveness of Embodiment 6 by adding speech pitch period estimating section 801 and speech pitch recovering section 802 to speech processing apparatus in FIG. 12.

Embodiment 8

Figure 13:
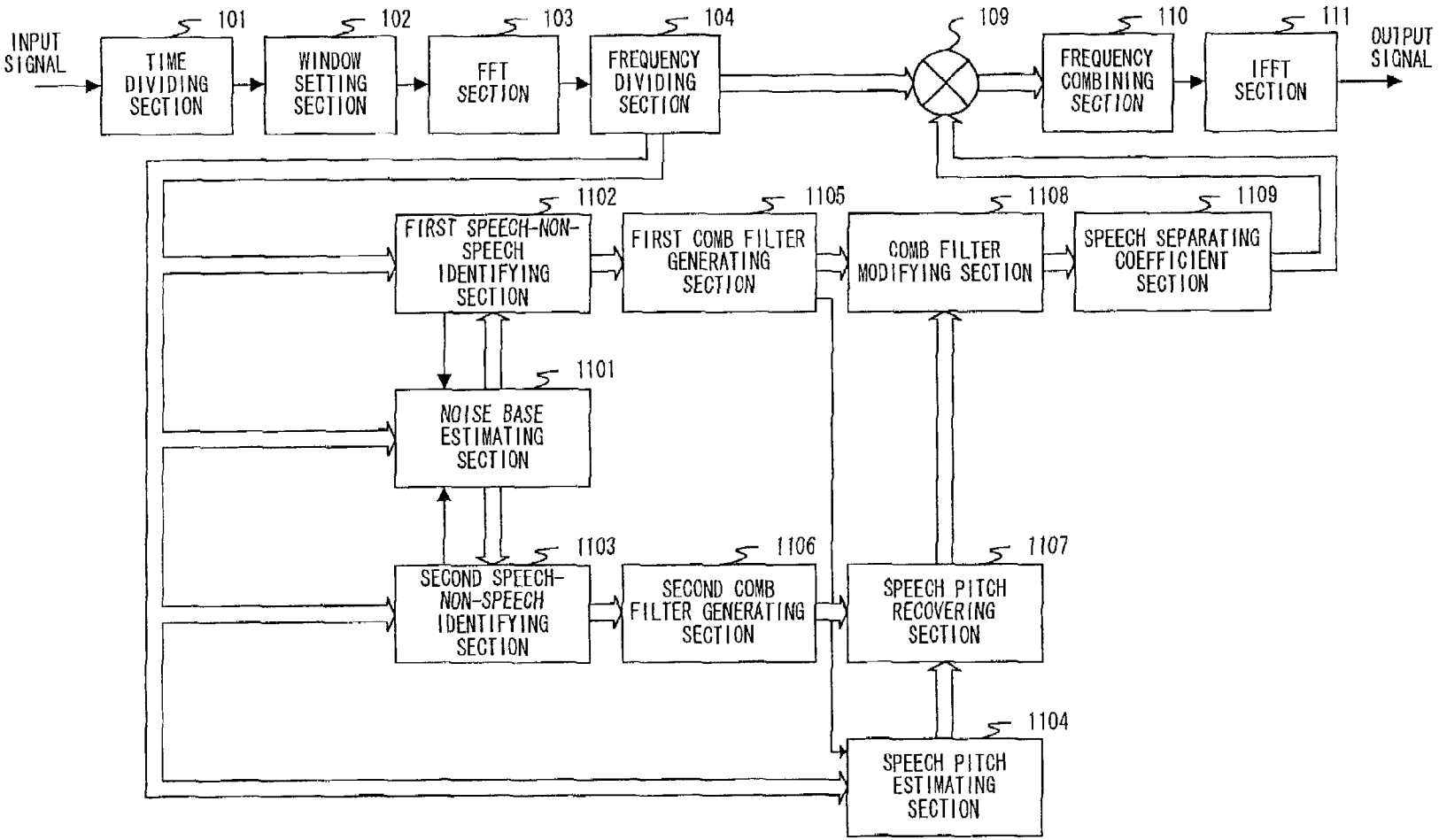
FIG. 13 is a block diagram illustrating an example of a configuration of a speech processing apparatus according to Embodiment 8.

FIG. 13 is a block diagram illustrating an example of a configuration of a speech processing apparatus according to Embodiment 8. In addition, in FIG. 13 sections common to FIG. 3 are assigned the same reference numerals as in FIG. 3 to omit specific descriptions.

The speech processing apparatus in FIG. 13 is provided with noise base estimating section 1101, first speech-non-speech identifying section 1102, second speech-non-speech identifying section 1103, speech pitch estimating section 1104, first comb filter generating section 1105, second comb filter generating section 1106, speech pitch recovering section 1107, comb filter modifying section 1108, and speech separating coefficient section 1109, generates a noise base used in generating a comb filter and a noise base used in recovering a pitch harmonic structure under different conditions, and in this respect, differs from the speech processing apparatus in FIG. 3.

In FIG. 13, frequency dividing section 104 divides the speech spectrum output from FFT section 103 into frequency components, and outputs the speech spectrum for each frequency component to noise base estimating section 1101, first speech-non-speech identifying section 1102, second speech-non-speech identifying section 1103, and speech pitch estimating section 1104.

Noise base estimating section 1101 outputs a noise base previously estimated to first speech-non-speech identifying section 1102 when the section 1102 outputs a determination indicating that the frame includes a speech component. Further, noise base estimating section 1101 outputs the noise base previously estimated to second speech-non-speech identifying section 1103 when the section 1103 outputs a determination indicating that the frame includes a speech component.

Meanwhile, when first speech-non-speech identifying section 1102 or second speech-non-speech identifying section 1103 outputs a determination indicating that the frame does not include a speech component, noise base estimating section 1101 calculates the short-term power spectrum and a displacement average value indicative of an average value of variations in the spectrum for each frequency component of the speech spectrum output from frequency dividing section 104, further calculates a weighted average value of a previously calculated replacement average value and the power spectrum, and thereby calculates a new replacement average value.

Specifically, noise base estimating section 1101 estimates a noise base in each frequency component using equation (9) or (10) to output to first speech-non-speech identifying section 1102 or second speech-non-speech identifying section 1103:

$$P_{base}(n,k)=(1-\alpha)\cdot P_{base}(n-1,k)+\alpha\cdot S^2_f(n,k) \quad (9)$$

$$P_{base}(n,k)=P_{base}(n-1,k) \quad (10)$$

where n is a number for specifying a frame to be processed, k is a number for specifying a frequency component, and $S^2_f(n,k)$, $P_{base}(n,k)$ and $\alpha(k)$ respectively indicate power spectrum of an input speech signal, replacement average value of a noise base, and replacement average coefficient.

When the power spectrum of the input speech signal is not more than a multiplication of the power spectrum of a previously input speech signal by a threshold for determining whether a signal is of a speech or noise, noise base estimating section 1101 outputs a noise base obtained from equation (9). Meanwhile, when the power spectrum of the input speech signal is more than a multiplication of the power spectrum of a previously input speech signal by the threshold for determining whether a signal is of a speech or noise, noise base estimating section 1101 outputs a noise base obtained from equation (10).

In the case where a difference is not less than a first threshold between the speech spectral signal output from frequency dividing section 104 and a value of the noise base output from noise base estimating section 1101, first speech-non-speech identifying section 1102 determines the signal as a speech portion including a speech component, while in the other case, determining the signal as a non-speech portion with only a noise and no speech component included.

First speech-non-speech identifying section 1102 sets the first threshold at a value lower than a second threshold, described later, used in second speech-non-speech identifying section 1103 so that first comb filter generating section 1105 generates a comb filter for extracting pitch harmonic information as much as possible. Then, first speech-non-speech identifying section 1102 outputs a determination to first comb filter generating section 1105.

In the case where a difference is not less than a predetermined second threshold between the speech spectral signal output from frequency dividing section 104 and a value of the noise base output from noise base estimating section 1101, second speech-non-speech identifying section 1103 determines the signal as a speech portion including a speech component, while in the other case, determining the signal as a non-speech portion with only a noise and no speech component included. Then, second speech-non-speech identifying section 1103 outputs a determination to second comb filter generating section 1106.

Based on the presence or absence of a speech component in each frequency component, first comb filter generating section 1105 generates a first comb filter for enhancing pitch harmonics to output to comb filter modifying section 1108.

Specifically, when first speech-non-speech identifying section 1102 determines that the power spectrum of the input speech signal is not less than the multiplication of the power spectrum of the input speech signal by the first threshold for determining whether a signal is of a speech or noise, in other words, in the case of meeting equation (11), first comb filter generating section 1105 sets a value of the filter in a corresponding frequency at "1":

$$S^2_f(n,k) \geqq \theta_{low} \cdot P_{base}(n,k) \tag{11}$$

Meanwhile, when first speech-non-speech identifying section 1102 determines that the power spectrum of the input speech signal is less than the multiplication of the power spectrum of the input speech signal by the first threshold for determining whether a signal is of a speech or noise, in other words, in the case of meeting equation (12), first comb filter generating section 1105 sets a value of the filter in a corresponding frequency component at "0":

$$S^2_f(n,k) < \theta_{low} \cdot P_{base}(n,k) \tag{12}$$

Herein, k is a number for specifying a frequency component, and meets a value in equation (13) described below. HB indicates the number of data points in the case where a speech signal undergoes Fast Fourier Transform.

$$0 \leqq k < HB/2 \tag{13}$$

Based on the presence or absence of a speech component in each frequency component, second comb filter generating section 1106 generates second comb filter for enhancing pitch harmonics to output to speech pitch recovering section 1107.

Specifically, when second speech-non-speech identifying section 1103 determines that the power spectrum of the input speech signal is not less than the multiplication of the power spectrum of the input speech signal by a second threshold for determining whether a signal is of a speech or noise, in other words, in the case of meeting equation (14), second comb filter generating section 1106 sets a value of the filter in a corresponding frequency component at "1":

$$S^2_f(n,k) \geqq \theta_{high} \cdot P_{base}(n,k) \tag{14}$$

Meanwhile, when second speech-non-speech identifying section 1103 determines that the power spectrum of the input speech signal is less than the multiplication of the power spectrum of the input speech signal by the second threshold for determining whether a signal is of a speech or noise, in other words, in the case of meeting equation (15), second comb filter generating section 1105 sets a value of the filter in a corresponding frequency component at "0":

$$S^2_f(n,k) < \theta_{high} \cdot P_{base}(n,k) \tag{15}$$

Speech pitch estimating section 1104 estimates a pitch period from the speech spectrum output from frequency dividing section 104, and outputs an estimation to speech pitch recovering section 1107.

For example, speech pitch estimating section 1104 obtains a pitch period using following equation (17) of auto-correlation function on speech spectral power in pass frequency in the generated comb filter:

$$\gamma(\tau) = \sum_{k=0}^{k1} [S^2_f(k) \cdot S^2_f(k+\tau) \cdot \text{COMB_low}(k) \cdot \text{COMB_low}(k+\tau)] \tag{17}$$

Herein, COMB_low(k) indicates a first comb filter generated in first comb filter generating section 1105, k1 indicates an upper limit of frequency, and $\tau$ indicates a period of a pitch and ranges from 0 to $\tau 1$ that is the maximum period.

Then, speech pitch estimating section 1104 obtains $\tau$ that maximizes $\gamma(\tau)$ as a pitch period. Since a shape of a pitch waveform tends to be unclear in high frequencies in actual processing, the section 1104 uses an intermediate frequency value as a value of k, and estimates a pitch period in a lower frequency half in the frequency region of a speech signal. For example, speech pitch estimating section 1104 sets k1 at 2 kHz (k1=2 kHz) to estimate a speech pitch period.

Speech pitch recovering section 1107 recovers the second comb filter based on the estimation output from speech pitch estimating section 1104 to output comb filter modifying section 1108.

The operation of speech pitch recovering section 1107 will be described below with reference to drawings. FIGS. 14 to 17 are graphs each showing an example of a comb filter.

Figure 14:
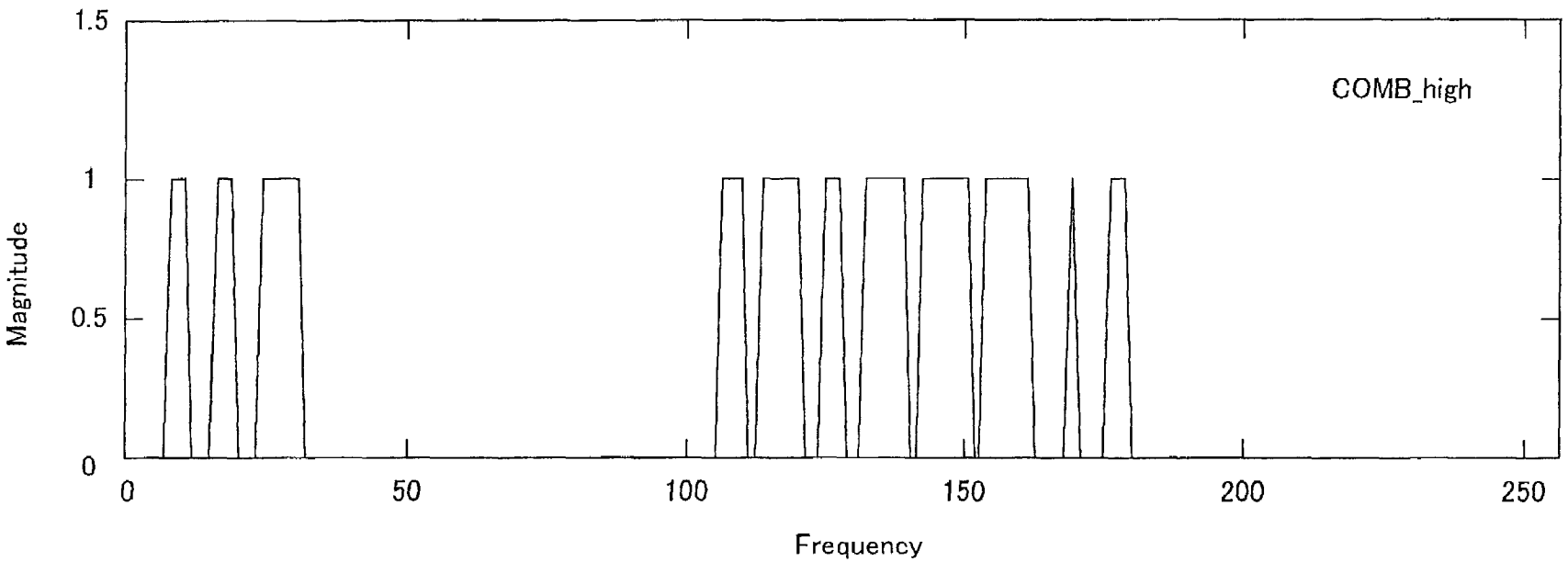
FIG. 14 is a graph showing an example of a comb filer.
Figure 15:
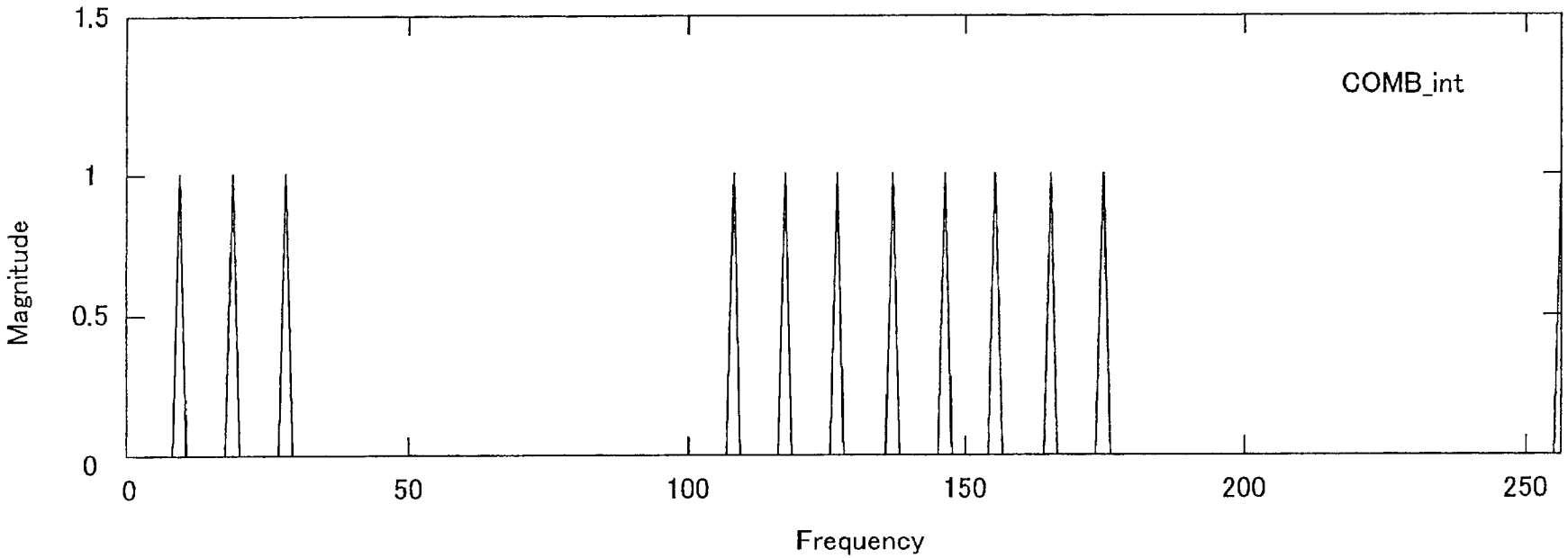
FIG. 15 is a graph showing another example of the comb filer.

Speech pitch recovering section 1107 extracts a peak at a passband of the second comb filter, and generates a pitch reference comb filter. The comb filter in FIG. 14 is an example of the second comb filter generated in second comb filter generating section 1106. The comb filter in FIG. 15 is an example of the pitch reference comb filter. The comb filter in FIG. 15 results from extracting only peak information from the comb filter in FIG. 14, and loses information of widths of passbands.

Figure 16:
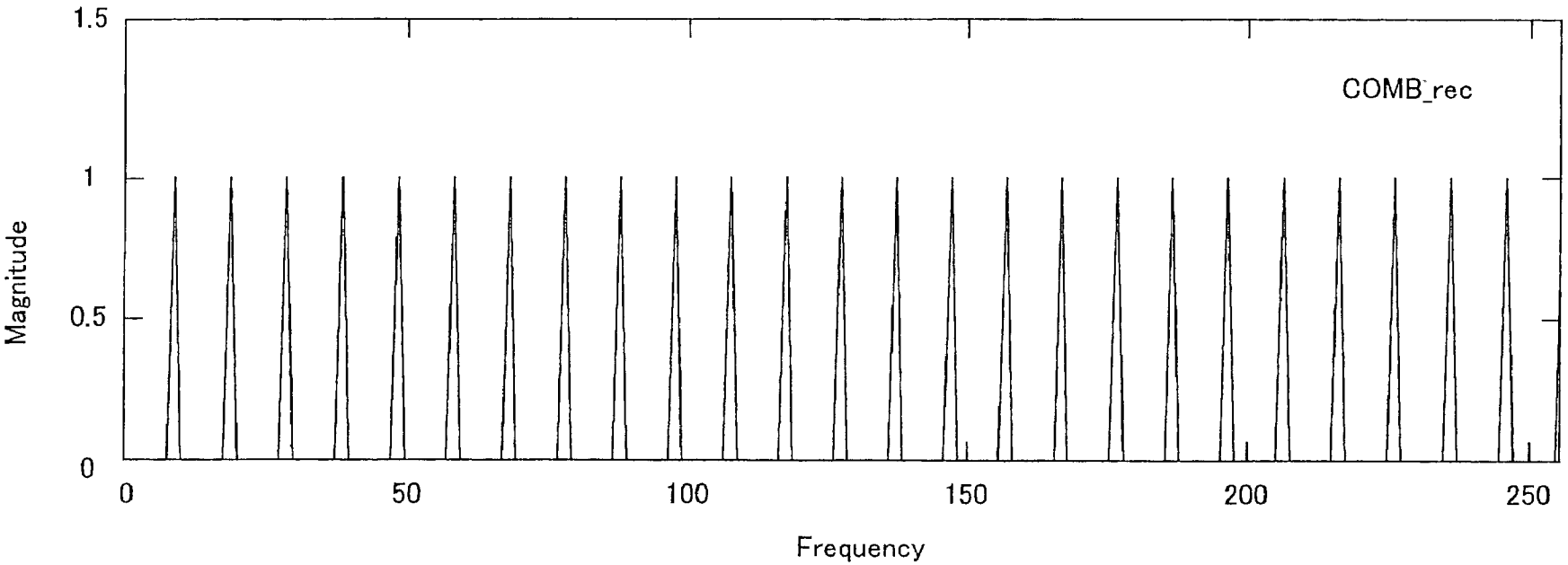
FIG. 16 is a graph showing another example of the comb filer.

Then, speech pitch recovering section 1107 calculates an interval between peaks in the pitch reference comb filter, inserts a lost pitch from the estimation of the pitch in speech pitch estimating section 1104 when the interval between peaks exceeds a predetermined threshold, for example, a value 1.5 times the pitch period, and generates a pitch insert comb filter. The comb filter in FIG. 16 is an example of the pitch insert comb filter. In the comb filter in FIG. 16 peaks are inserted in a band approximately ranging from k=50 to k=100, which corresponds to a frequency region from 781 Hz to 1563 Hz, and in a band approximately ranging from k=200 to k=250, which corresponds to a frequency region from 3125 Hz to 3906 Hz.

Figure 17:
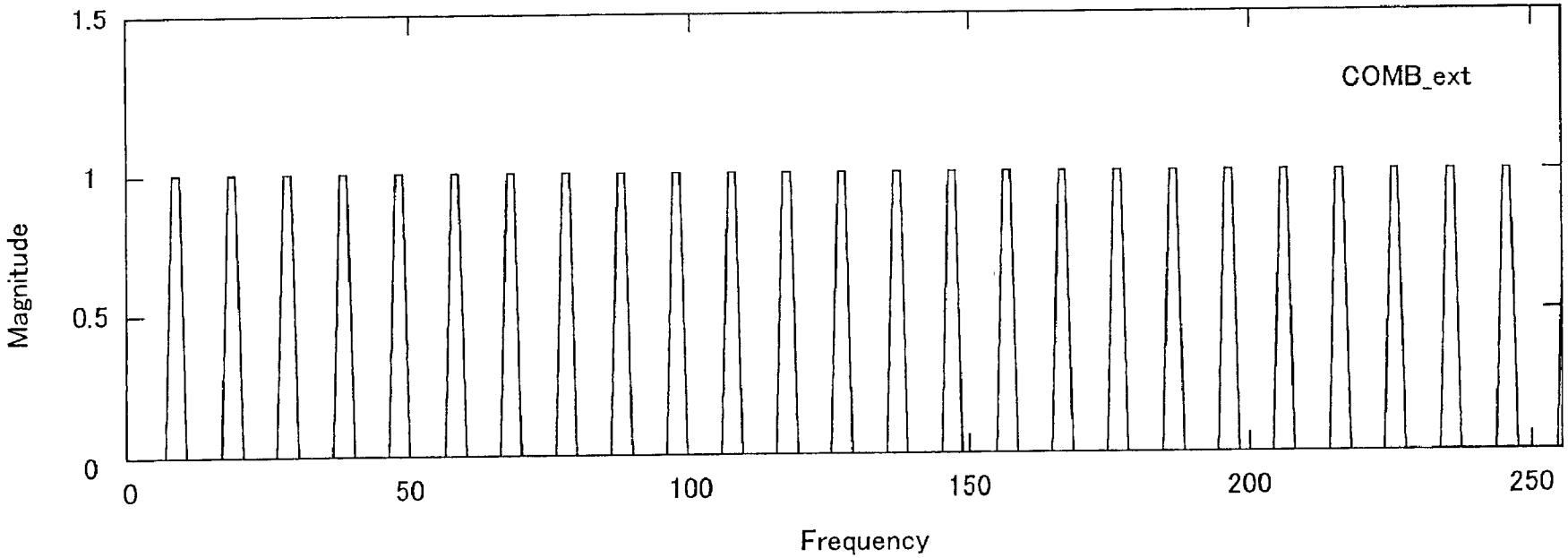
FIG. 17 is a graph showing another example of the comb filer.

Speech pitch recovering section 1107 extends a width of a peak in a passband of the pitch insert comb filter corresponding to value of the pitch, and generates a pitch recover comb filter to output to comb filter modifying section 1108. The comb filter in FIG. 17 is an example of the pitch recover comb filter. The comb filter in FIG. 17 is obtained by adding the information of widths in passbands to the pitch insert comb filter in FIG. 16.

Using the pitch recover comb filter generated in speech pitch recovering section 1107, comb filter modifying section 1108 modifies the first comb filter generated in first comb filter generating section 1105, and outputs the modified comb filter to speech separating coefficient calculating section 1109.

Specifically, comb filter modifying section 1108 compares passbands of the pitch recover comb filter and of the first comb filter, obtains a portion that is a passband in both comb filters as a passband, sets bands except thus obtained passbands as rejection bands for attenuating a signal, and thereby generates a comb filter.

Figure 18:
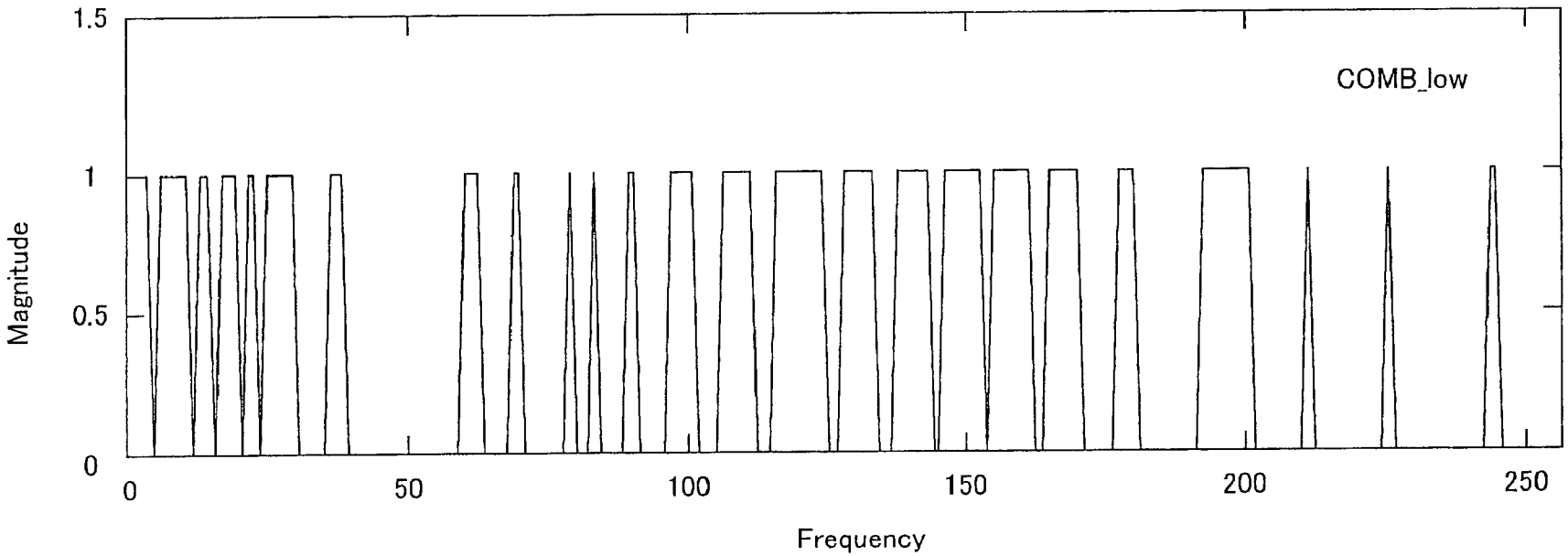
FIG. 18 is a graph showing another example of the comb filer.
Figure 19:
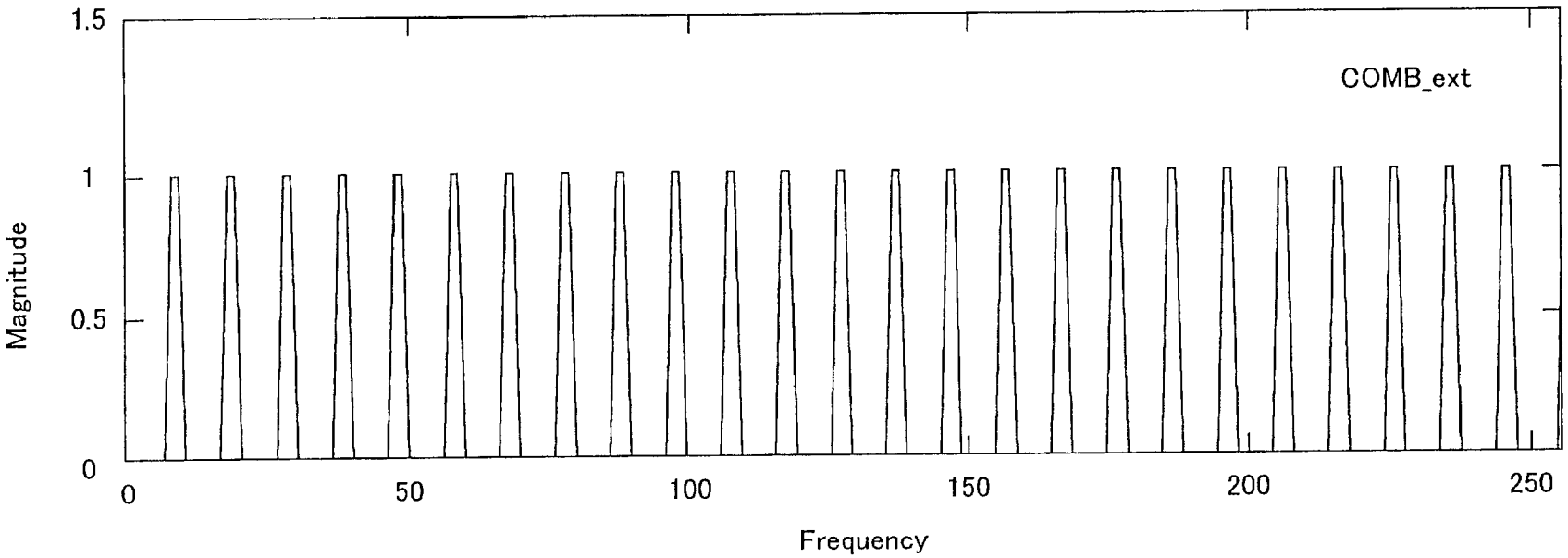
FIG. 19 is a graph showing another example of the comb filer.
Figure 20:
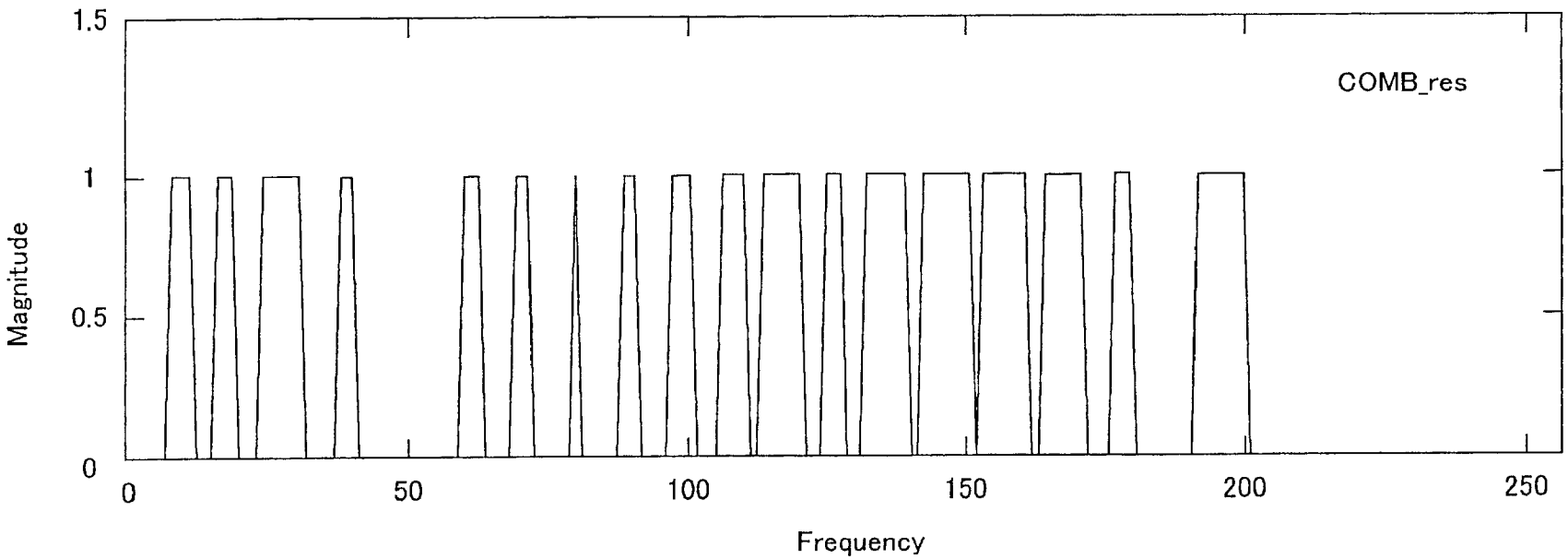
FIG. 20 is a graph showing another example of the comb filer.

Examples of the comb filter modification will be described. FIGS. 18 to 20 are graphs each showing an example of the comb filter. The comb filter in FIG. 18 is the first comb filter generated in first comb filter generating section 1105. The comb filter in FIG. 19 is the pitch recover comb filter generated in speech pitch recovering section 1107. FIG. 20 shows an example of the comb filter modified in comb filter modifying section 1108.

Speech separating coefficient calculating section 1109 multiplies the comb filter modified in comb filter modifying section 1108 by a separating coefficient based on frequency characteristics, and calculates a separating coefficient of an input signal for each frequency component to output to multiplying section 109.

For example, with respect to number k for specifying a frequency component, in the case where a value of COMB_res(k) of the comb filter modified in comb filter modifying section 1108 is 1, i.e., in the case of passband, speech separating coefficient calculating section 1109 sets separating coefficient seps(k) at 1. Meanwhile, in the case where a value of COMB_res(k) of the comb filter is 0, i.e., in the case of rejection band, speech separating coefficient calculating section 1109 calculates separating coefficient seps(k) from following equation (18(18):

$$\mathrm{seps}(k)=gc\cdot k/HB \tag{18}$$

where gc indicates a constant, k indicates a number for specifying a frequency component, and HB indicates an a transform length in FFT, i.e., the number of items of data in performing Fast Fourier Transform.

Multiplying section 109 multiplies the speech spectrum output from frequency dividing section 104 by the separating coefficient output from speech separating coefficient calculating section 1109 per frequency component basis. Then, the section 109 outputs the spectrum resulting from the multiplication to frequency combining section 110.

Thus, according to the speech processing apparatus of this embodiment, a noise base used in generating a comb filter and a noise base used in recovering a pitch harmonic structure are generated under different conditions, and it is thereby possible to extract more speech information, generate a comb filter apt not to be affected by noise information, and perform accurate recovery of pitch harmonic structure.

Specifically, according to the speech processing apparatus of this embodiment, a pitch harmonic structure of the comb filter is recovered by inserting a pitch supposed to be lost by reflecting a pitch period estimation using as a reference the second comb filter with a strict criterion for speech identification, and it is thereby possible to decrease speech distortions caused by a loss of pitch harmonics.

Further according to the speech processing apparatus of this embodiment, since a pitch width of the comb filter is adjusted using the pitch period estimation, it is possible to recover a pitch harmonic structure with accuracy. Passbands are compared of a comb filter obtained by recovering a pitch harmonic structure of a comb filter generated with a strict criterion for speech identification, and of a comb filter with a reduced criterion for speech identification, an overlap portion of the passbands is set as a passband, and a comb filter with bands except the overlap passbands set as rejection bands is generated. As a result, it is possible to reduce effects caused by an error in pitch period estimation, and to recover a pitch harmonic structure with accuracy.

In addition, it is also possible in the speech processing apparatus of this embodiment to calculate a speech separating coefficient for a rejection band of a comb filter by multiplying a speech spectrum by a separating coefficient, and to calculate a speech separating coefficient for a passband of a comb filter by subtracting a noise base from a speech spectrum.

For example, in the case where a value of COMB_res(k) of the comb filter is 0, i.e., in the case of rejection band, speech separating coefficient calculating section 1109 calculates separating coefficient seps(k) from following equation (19):

$$\mathrm{seps}(k)=gc\cdot P_{max}(n)/P_{base}(n,k) \tag{19}$$

where $P_{max}$ indicates a maximum value of $P_{base}(n,k)$ in frequency component k of predetermined range. In equation (19) a noise base estimation value is normalized for each frame, and its reciprocal is used as a separating coefficient.

In the case where a value of COMB_res(k) of the comb filter is 1, i.e., in the case of passband, speech separating coefficient calculating section 1109 calculates separating coefficient seps(k) from following equation (20):

$$\mathrm{seps}(k)=S^2_f(k)-\gamma P_{base}(n,k)/S^2_f(k) \tag{20}$$

where γ is a coefficient indicative of an amount of noise base to be subtracted, and $P_{max}$ indicates a maximum value of $P_{base}(n,k)$ in frequency component k of predetermined range.

Thus, the speech processing apparatus of this embodiment enables calculation of an optimal separating coefficient for different noise characteristics by multiplying a separating coefficient calculated from information of noise base in a rejection band of the comb filter subjected to pitch modification, and thereby enables pitch enhancement corresponding to noise characteristics. Further, the speech processing apparatus of this embodiment multiplies a separating coefficient calculated by subtracting a noise base from a speech spectrum in a passband with the comb filter subjected to pitch modification, and thereby enables pitch enhancement with less speech distortions.

Moreover, this embodiment is capable of being combined with Embodiment 2. That is, it is possible to obtain the effectiveness of Embodiment 2 also by adding noise interval determing section 401 and noise base tracking section 402 to the speech processing apparatus in FIG. 13.

Embodiment 9

Figure 21:
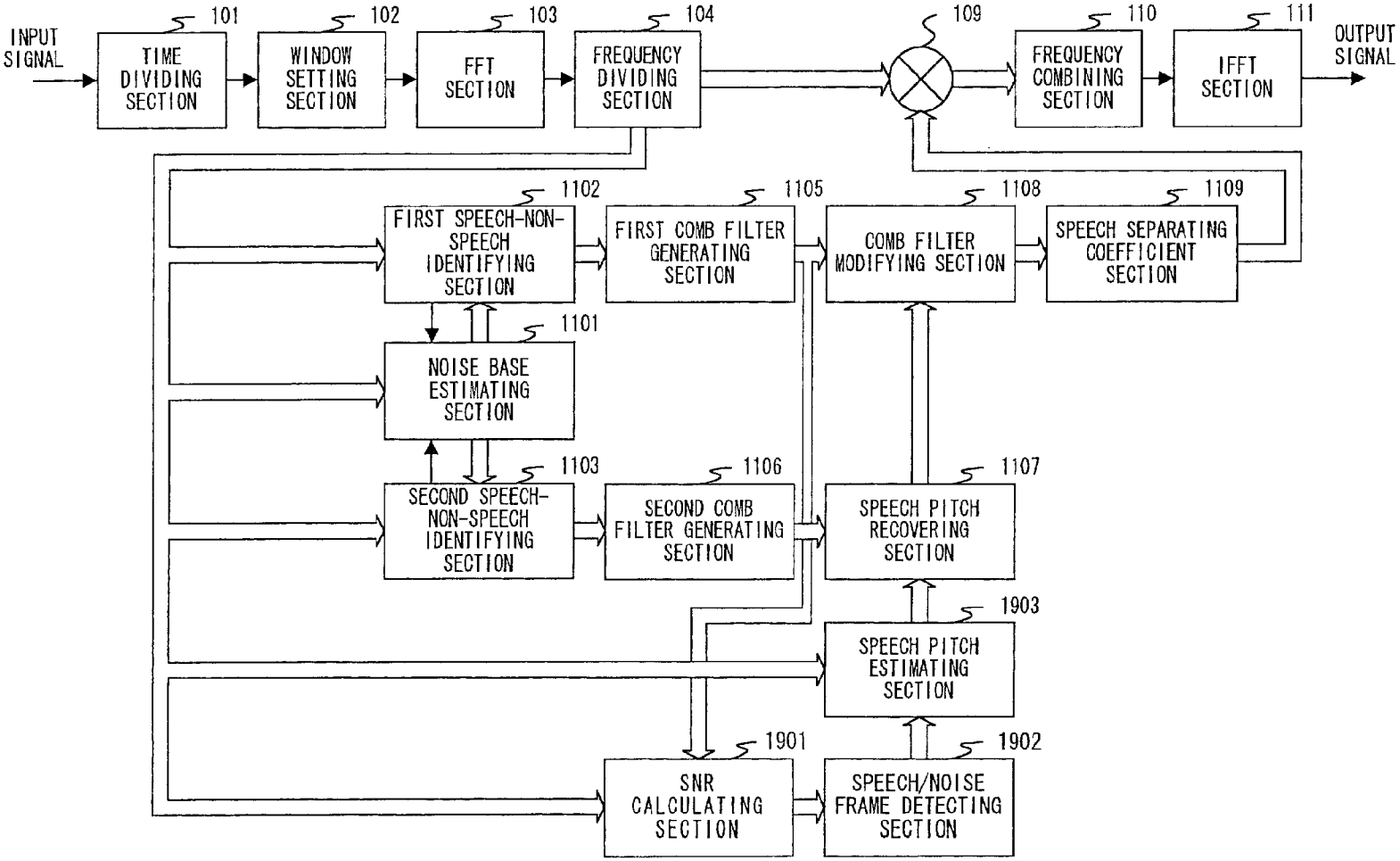
FIG. 21 is a block diagram illustrating an example of a configuration of a speech processing apparatus according to Embodiment 9.

FIG. 21 is a block diagram illustrating an example of a configuration of a speech processing apparatus according to Embodiment 9. In addition, in FIG. 21 sections common to FIGS. 3 and 13 are assigned the same reference numerals as in FIGS. 3 and 13 to omit specific descriptions.

The speech processing apparatus in FIG. 21 is provided with SNR calculating section 1901 and speech/noise frame detecting section 1902, calculates SNR (Signal Noise Ratio) of a speech signal, distinguishes between a speech frame and noise frame using SNR to detect from a speech signal per frame basis, estimates a pitch period only of a speech frame, and in this respect, differs from the speech processing apparatus in FIG. 3 or FIG. 13.

In FIG. 21 frequency dividing section 104 divides the speech spectrum output from FFT section 103 into frequency components, and outputs the speech spectrum for each frequency component to noise base estimating section 105, first speech-non-speech identifying section 1102, second speech-non-speech identifying section 1103, multiplying section 109, and SNR calculating section 1901.

Based on the presence or absence of a speech component in each frequency component, first comb filter generating section 1105 generates a comb filter for enhancing pitch harmonics to output to comb filter modifying section 1108 and SNR calculating section 1901.

SNR calculating section 1901 calculates SNR of a speech signal from the speech spectrum output from frequency dividing section 104 and the first comb filter output from first comb filter generating section 1105 to output to speech/noise frame detecting section 1902. For example, SNR calculating section 1901 calculates SNR using equation (21) as described below:

$$SNR(n) = \frac{\sum \lfloor S_f^2(k) \cdot \mathrm{COMB_low}(k) \rfloor / \sum \mathrm{COMB_low}(k)}{\sum \{S_f^2(k) \cdot [1 - \mathrm{COMB_low}(k)]\} / \sum [1 - \mathrm{COMB_low}(k)]} \quad (21)$$

where COMB_low(k) indicates the first comb filter, and k indicates a frequency component and ranges from 0 to a number less than half the number of data points when the speech signal undergoes Fast Fourier Transform.

Speech/noise detecting section 1902 determines whether an input signal is a speech signal or noise signal per frame basis from SNR output from SNR calculating section 1901, and outputs a determination to speech pitch estimating section 1903. Specifically, speech/noise frame detecting section 1902 determines that the input signal is a speech signal (speech frame) when SNR is larger than a predetermined threshold, while determining the input signal is a noise signal (noise frame) when a predetermined number of frames occur successively whose SNR is not more than the predetermined threshold.

FIG. 22 shows an example of a program representative of the operation of speech/noise determination in speech/noise frame detecting section 1902 described above. FIG. 22 is a view showing an example of a speech/noise determination program in the speech processing apparatus in this embodiment. In the program in FIG. 22, when 10 or more frames occur successively whose SNR is not more than the predetermined threshold, the input signal is determined to be a noise signal (noise frame).

When speech/noise frame detecting section 1902 determines the input signal is a speech frame, speech pitch estimating section 1903 estimates a pitch period from the speech spectrum output from frequency dividing section 104, and outputs an estimation to speech pitch recovering section 1107. The operation in the pitch period estimation is the same as the operation in speech pitch estimating section 1104 in Embodiment 8.

Speech pitch recovering section 1107 recovers the second comb filter based on the estimation output from speech pitch estimating section 1903 to output to comb filter modifying section 1108.

Thus, according to the speech processing apparatus of this embodiment, SNR is obtained by calculating a ratio of a sum of power of the speech spectra corresponding to passbands of the comb filter to a sum of power of speech spectra corresponding to rejection bands of the comb filter, and only when SNR is not less than a predetermined threshold, a pitch period is estimated. It is thereby possible to reduce errors due to noise in the pitch period estimation, and to perform speech enhancement with less speech distortions.

In addition, while in the speech processing apparatus in this embodiment SNR is calculated from the first comb filter, SNR may be calculated from the second comb filter. In this case, second comb filter generating section 1106 outputs the generated second comb filter to SNR calculating section 1901. SNR calculating section 1901 calculates SNR of a speech signal from the speech spectrum output from frequency dividing section 104 and the second comb filter to output to speech/noise frame detecting section 1902.

Embodiment 10

Figure 23:
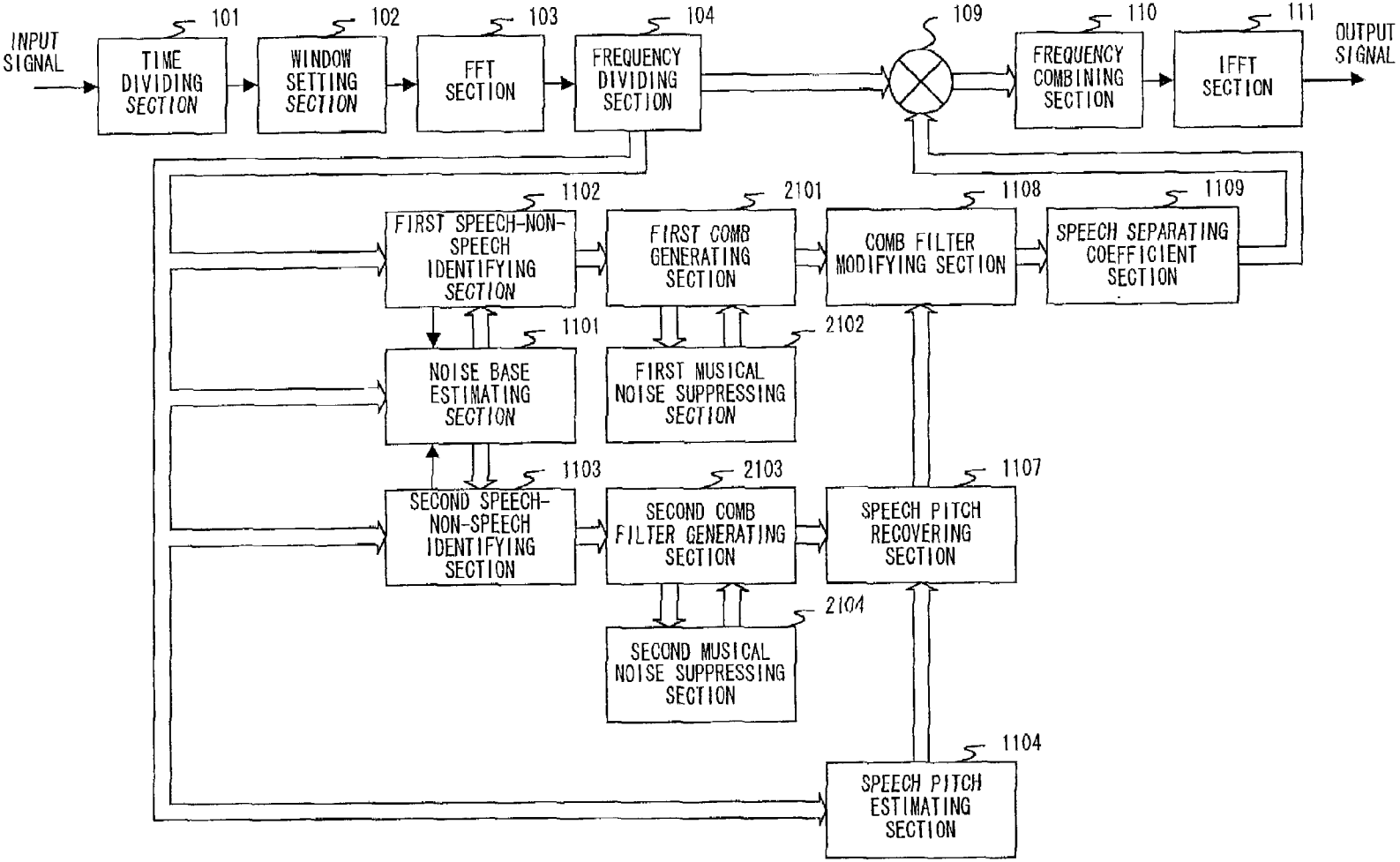
FIG. 23 is a block diagram illustrating an example of a configuration of a speech processing apparatus according to Embodiment 10.

FIG. 23 is a block diagram illustrating an example of a configuration of a speech processing apparatus according to Embodiment 10. In addition, in FIG. 23 sections common to FIGS. 3 and 13 are assigned the same reference numerals as in FIGS. 3 and 13 to omit specific descriptions. The speech processing apparatus in FIG. 23 is provided with first comb filter generating section 2101, first musical noise suppressing section 2102, second comb filter generating section 2103, and second musical noise suppressing section 2104, determines whether a musical noise occurs from generation results of the first comb filter and second comb filter, and in this respect, differs from the speech processing apparatus in FIG. 3 or FIG. 13.

In FIG. 23 in the case where a difference is not less than a first threshold between the speech spectral signal output from frequency dividing section 104 and a value of the noise base output from noise base estimating section 1101, first speech-non-speech identifying section 1102 determines the signal as a speech portion including a speech component, while in the other case, determining the signal as a non-speech portion with only a noise and no speech component included.

First speech-non-speech identifying section 1102 sets the first threshold at a value lower than a second threshold, described later, used in second speech-non-speech identifying section 1103 so that first comb filter generating section 2101 generates a comb filter for extracting pitch harmonic information as much as possible. Then, first speech-non-speech identifying section 1102 outputs a determination to first comb filter generating section 2101.

In the case where a difference is not less than a second threshold between the speech spectral signal output from frequency dividing section 104 and a value of the noise base output from noise base estimating section 1101, second speech-non-speech identifying section 1103 determines the signal as a speech portion including a speech component, while in the other case, determining the signal as a non-speech portion with only a noise and no speech component included. Then, second speech-non-speech identifying section 1103 outputs a determination to second comb filter generating section 2103.

Based on the presence or absence of a speech component in each frequency component, first comb filter generating section 2101 generates a first comb filter for enhancing pitch harmonics to output to first musical noise suppressing section 2102. The specific operation of the first comb filter generation is the same as in first comb filter generating section 1105 in Embodiment 8. First comb filter generating section 2101 outputs the first comb filter modified in first musical noise suppressing section 2101 to comb filter modifying section 1108.

When the number of "ON" states of frequency components of the first comb filter, i.e., the number of states where a signal is output without being attenuated, is not more than a predetermined threshold, first musical noise suppressing section 2102 determines that a frame includes a sudden noise. For example, the number of "ON" frequency components in the comb filter is calculated using following equation (5), and it is determined that a musical noise occurs when COMB_SUM(n) is not more than a predetermined threshold (for example, 10).

$$\mathrm{COMB_SUM}(n) = \sum_{k=0}^{HB/2} \mathrm{COMB_ON}(n, k) \tag{5}$$

First musical noise suppressing section 2102 sets all the states of frequency components of the comb filter at "OFF", i.e., a state of attenuating the signal to output, and outputs the comb filter to first comb filter generating section 2101.

Based on the presence or absence of a speech component in each frequency component, second comb filter generating section 2103 generates a second comb filter for enhancing pitch harmonics to output to second musical noise suppressing section 2104. The specific operation of the second comb filter generation is the same as in second comb filter generating section 1106 in Embodiment 8. Second comb filter generating section 2103 outputs the second comb filter modified in second musical noise suppressing section 2104 to speech pitch recovering section 1107.

When the number of "ON" states of frequency components of the first comb filter, i.e., the number of states where a signal is output without being attenuated, is not more than a predetermined threshold, second musical noise suppressing section 2102 determines that a frame includes a sudden noise. For example, the number of "ON" frequency components in the comb filter is calculated using following equation (5), and it is determined that a musical noise occurs when COMB_SUM(n) is not more than a predetermined threshold (for example, 10).

$$\mathrm{COMB_SUM}(n) = \sum_{k=0}^{HB/2} \mathrm{COMB_ON}(n, k) \tag{5}$$

Second musical noise suppressing section 2104 sets all the states of frequency components of the comb filter at "OFF", i.e., a state of attenuating the signal to output, and outputs the comb filter to second comb filter generating section 2103.

Speech pitch recovering section 1107 recovers the second comb filter output from second comb filter generating section 2103 based on the estimation output from speech pitch estimating section 1104 to output to comb filter modifying section 1108.

Using the pitch recover comb filter generated in speech pitch recovering section 1107, comb filter modifying section 1108 modifies the first comb filter generated in first comb filter generating section 2101, and outputs the modified comb filter to speech separating coefficient calculating section 1109.

Thus, according to the speech processing apparatus of this embodiment, whether a musical noise occurs is determined from generation results of the first comb filter and second comb filter, and it is thereby possible to prevent a noise from being mistaken for a speech signal and to perform speech enhancement with less speech distortions.

Embodiment 11

Figure 24:
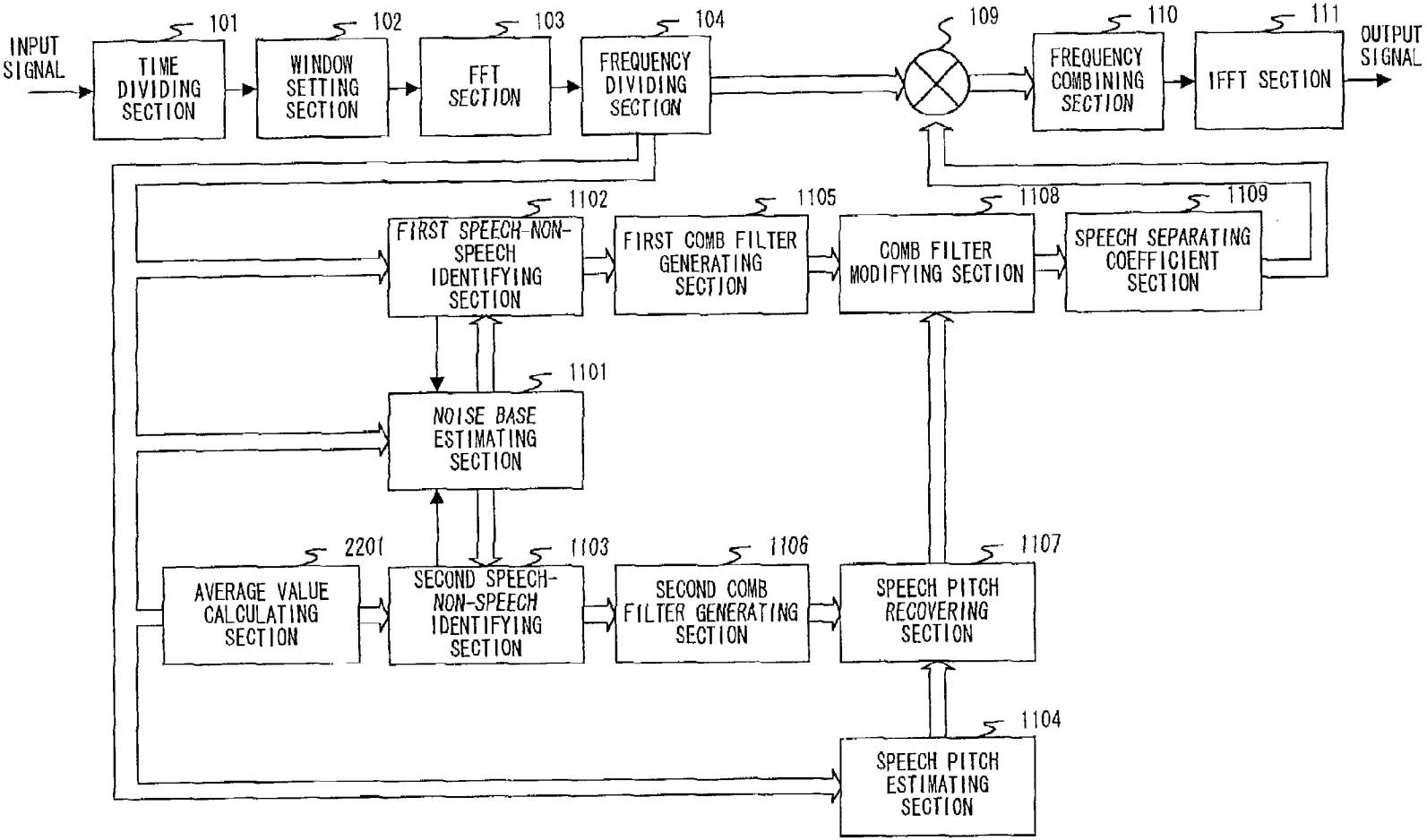
FIG. 24 is a block diagram illustrating an example of a configuration of a speech processing apparatus according to Embodiment 11.

FIG. 24 is a block diagram illustrating an example of a configuration of a speech processing apparatus according to Embodiment 11. In addition, in FIG. 24 sections common to FIGS. 3 and 13 are assigned the same reference numerals as in FIGS. 3 and 13 to omit specific descriptions. The speech processing apparatus in FIG. 24 is provided with average value calculating section 2201, obtains an average value of power of speech spectrum per frequency component basis, and in this respect, differs from the apparatus in FIGS. 3 and 13.

In FIG. 24, frequency dividing section 104 divides the speech spectrum output from FFT section 103 into frequency components, and outputs the speech spectrum for each frequency component to noise base estimating section 1101, first speech-non-speech identifying section 1102, multiplying section 109 and average value calculating section 2201.

With respect to power of the speech spectrum output from frequency dividing section 104, average value calculating section 2201 calculates an average value of such power and peripheral frequency components and an average value of such power and previously processed frames, and outputs the obtained average values to second speech-non-speech identifying section 1103.

Specifically, an average value of speech spectra is calculated using equation (22) indicated below:

$$\overline{S_f^2(n, k)} = \sum_{j=k1}^{k2} S_f^2(i, j) \tag{22}$$

where k1 and k2 indicate frequency components and k1<k<k2, n1 is a number indicating a frame previously processed, and n is a number indicating a frame to be processed.

Second speech-non-speech identifying section 1103 determines the signal as a speech portion including a speech component in the case where a difference is not less than a predetermined second threshold between the average value of the speech spectral signal output from average value calculating section 2201 and a value of the noise base output from noise base estimating section 1101, while determining the signal as a non-speech portion with only a noise and no speech component included in the other case. Second speech-non-speech identifying section 1103 outputs the determination to second comb filter generating section 1106.

Thus, according to the speech processing apparatus according to Embodiment 11, a power average value of speech spectrum or power average values of previously processed frames and of frames to be processed are obtained for each frequency component, and it is thereby possible to decrease adverse effects of a sudden noise component, and to generate a second comb filter for extracting only speech information with more accuracy.

Embodiment 12

Figure 25:
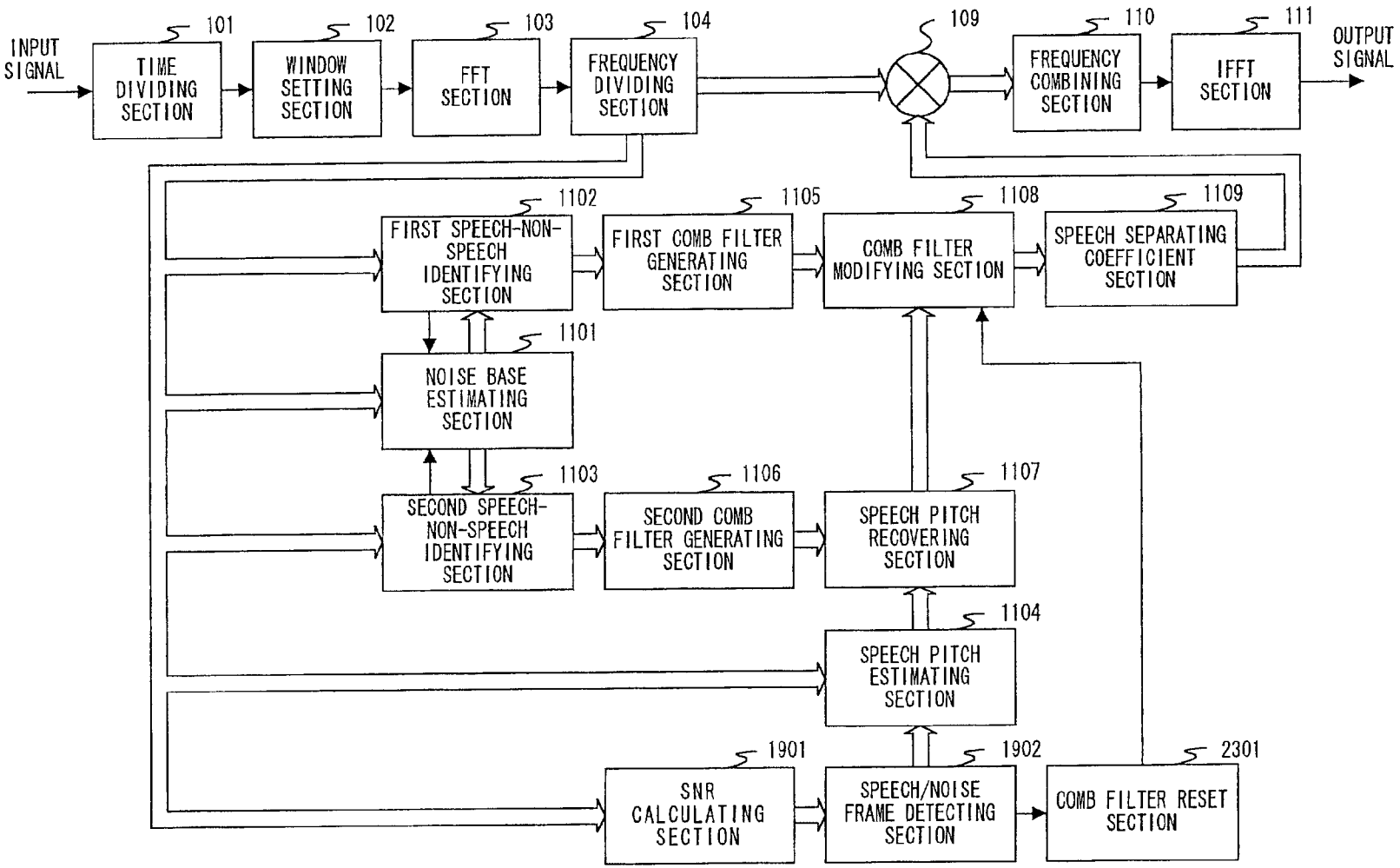
FIG. 25 is a block diagram illustrating an example of a configuration of a speech processing apparatus according to Embodiment 12.

FIG. 25 is a block diagram illustrating an example of a configuration of a speech processing apparatus according to Embodiment 12. In addition, in FIG. 25 sections common to FIGS. 3, 13 and 21 are assigned the same reference numerals as in FIGS. 3, 13 and 21 to omit specific descriptions. The speech processing apparatus in FIG. 25 is provided with comb filter reset section 2301, generates a comb filter for attenuating all frequency components in a frame with no speech component included, and in this respect, differs from the apparatus in FIG. 3, 13 or 21.

In FIG. 25 speech/noise frame detecting section 1902 determines whether an input signal is a speech signal or noise signal per frame basis from SNR output from SNR calculating section 1901, and outputs a determination to speech pitch estimating section 1104.

Specifically, speech/noise frame detecting section 1902 determines that the input signal is a speech signal (speech frame) when SNR is larger than a predetermined threshold, while determining the input signal is a noise signal (noise frame) when a predetermined number of frames occur successively whose SNR is not more than the predetermined threshold. Speech/noise frame detecting section 1902 outputs a determination to speech pitch estimating section 1104 and comb filter reset section 2301.

When it is determined that the speech spectrum is of only a noise component without including a speech component based on the determination output from speech/noise frame detecting section 1901, comb filter reset section 2301 outputs an instruction for making all the frequency components of the comb filter "OFF" to comb filter modifying section 1108.

Using the pitch recover comb filter generated in speech pitch recovering section 1107, comb filter modifying section 1108 modifies the first comb filter generated in first comb filter generating section 1105, and outputs the modified comb filter to speech separating coefficient calculating section 1109.

Further, when it is determined that the speech spectrum is of only a noise component without including a speech component, according to the instruction from comb filter reset section 2301, comb filter modifying section 1108 generates the first comb filter with all the frequency components made "OFF" to output to speech separating coefficient calculating section 1109.

In this way, according to the speech processing apparatus of this embodiment, a frame including no speech component is subjected to the attenuation in all the frequency components, thereby the noise is cut in the entire frequency band at a signal interval including no speech, and it is thus possible to prevent an occurrence of a noise caused by speech suppressing processing. As a result, it is possible to perform speech enhancement with less speech distortions.

Embodiment 13

Figure 26:
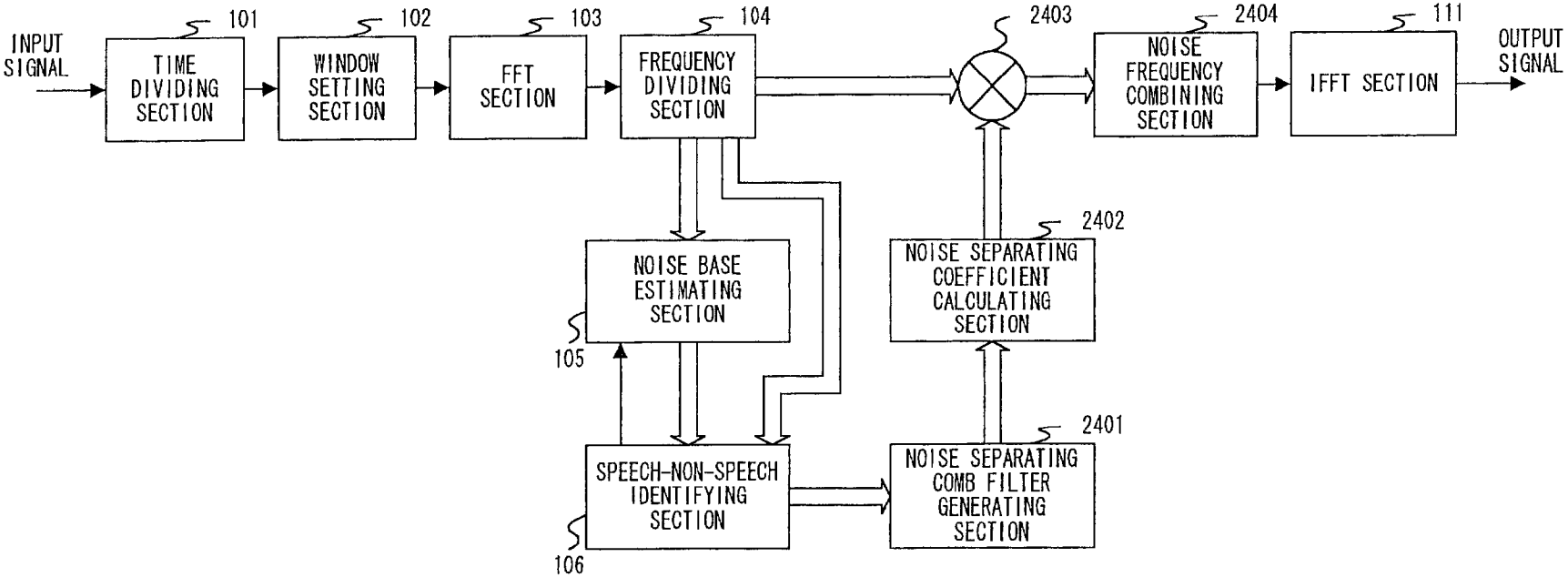
FIG. 26 is a block diagram illustrating an example of a configuration of a speech processing apparatus according to Embodiment 13.

FIG. 26 is a block diagram illustrating an example of a configuration of a speech processing apparatus in Embodiment 13. In addition, in FIG. 26 sections common to FIG. 3 are assigned the same reference numerals as in FIG. 3 to omit specific descriptions thereof.

The speech processing apparatus in FIG. 26 is provided with noise separating comb filter generating section 2401, noise separating coefficient calculating section 2402, multiplying section 2403 and noise frequency combining section 2404, determines a spectral signal is of speech or non-speech per frequency component basis, attenuates frequency characteristics based on the determination per frequency component basis, generates a comb filter for extracting only a noise component while obtaining accurate pitch information, thereby extracts noise characteristics, and in this respect, differs from the speech processing apparatus in FIG. 3.

In the case where a difference is not less than a predetermined threshold between the speech spectral signal output from frequency dividing section 104 and a value of the noise base output from noise base estimating section 105, speech-non-speech identifying section 106 determines the signal as a speech portion including a speech component, while in the other case, determining the signal as a non-speech portion with only a noise and no speech component included. Then, speech-non-speech identifying section 106 outputs the determination to noise base estimating section 105 and noise separating comb filter generating section 2401.

Based on the presence or absence of a speech component in each frequency component, noise separating comb filter generating section 2401 generates a comb filter for enhancing pitch harmonics, and outputs the comb filter to noise separating coefficient calculating section 2402.

Specifically, speech-non-speech identifying section 106 sets at "1" a value of the filter in a frequency component such that the power spectrum of the input speech signal is not less than a result of multiplication of the first threshold used in determination of speech or noise by the power spectrum of the input speech signal, i.e., following equation (23) is satisfied:

$$S^2_f(n,k) \geqq \theta_{nos} \cdot P_{base}(n,k) \tag{23}$$

Meanwhile, speech-non-speech identifying section 106 sets at "0" a value of a filter in a frequency component such that the power spectrum of the input speech signal is less than a result of multiplication of the first threshold used in determination of speech or noise by the power spectrum of the input speech signal, i.e., following equation (24) is satisfied:

$$S^2_f(n,k) < \theta_{nos} \cdot P_{base}(n,k) \tag{24}$$

Herein, $\theta_{nos}$ is a threshold used in noise separation.

Noise separating coefficient calculating section 2402 multiplies the comb filter generated in noise separating comb filter generating section 2401 by an attenuation coefficient based on the frequency characteristics, sets an attenuation coefficient of an input signal for each frequency component, and outputs the attenuation coefficient of each frequency component to multiplying section 2403. Specifically, in the case where a value of COMB_nos(k) of the comb filter is 0, i.e., in the case of rejection band, noise separating coefficient calculating section 2402 sets noise separating coefficient sepn(k) at 1 (sepn(k)=1).

Then, in the case where a value of COMB_nos(k) of the comb filter is 1, i.e., in the case of passband, the section 2402 calculates noise separating coefficient sepn(k) from following equation (25):

$$\mathrm{sepn}(k) = r_d(i) \cdot P_{base}(n,k) / S^2_f(k) \tag{25}$$

where rd(i) is a random function composed of random numbers of uniform distribution, and k ranges from 0 to a number half a transform length in FFT, i.e., the number of items of data in performing Fast Fourier Transform.

Multiplying section 2403 multiplies the speech spectrum output from frequency dividing section 104 by the noise separating coefficient output from noise separating coefficient calculating section 2402 per frequency component basis. Then, the section 2402 outputs the spectrum resulting from the multiplication to noise frequency combining section 2404.

Noise frequency combining section 2404 combines spectra of frequency component basis output from multiplying section 2403 to a speech spectrum continues in a frequency region per unit processing time basis to output to IFFT section 111. IFFT section 111 performs IFFT on the speech spectrum output from noise frequency combining section 2404, and outputs thus converted speech signal.

In this way, the speech processing apparatus in this embodiment determines a spectral signal is of speech or non-speech per frequency component basis, attenuates frequency characteristics based on the determination per frequency component basis, and thereby is capable of generating a comb filter for extracting only a noise component while obtaining accurate pitch information, and of extracting noise characteristics. Further, a noise component is not attenuated in a rejection band of the comb filter, and the noise component is reconstructed in a passband of the comb filter by multiplying an estimated value of noise base by a random number, whereby it is possible to obtain excellent noise separating characteristics.

Embodiment 14

Figure 27:
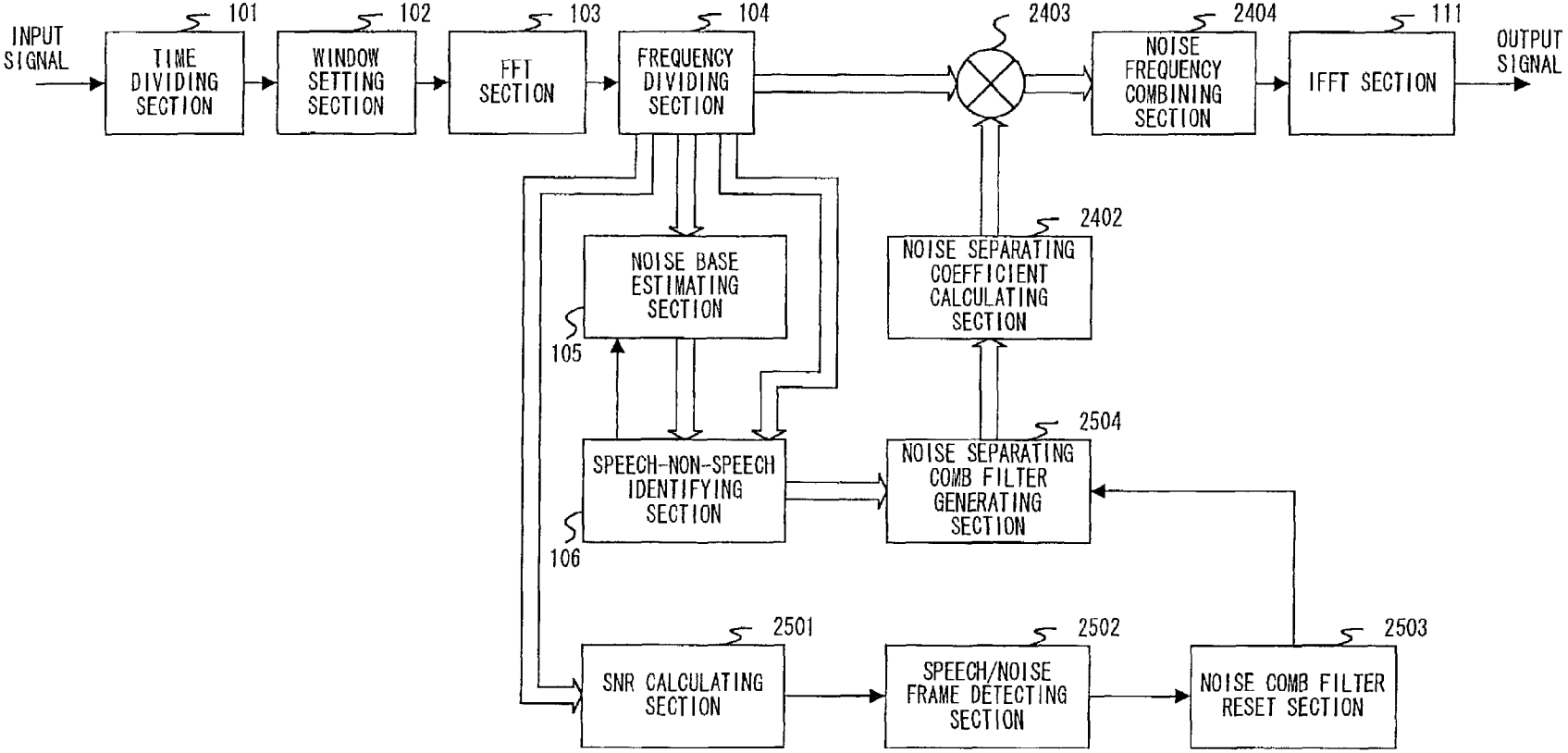
FIG. 27 is a block diagram illustrating an example of a configuration of a speech processing apparatus according to Embodiment 14.

FIG. 27 is a block diagram illustrating an example of a configuration of a speech processing apparatus in Embodiment 14. In addition, in FIG. 27 sections common to FIGS. 3 and 26 are assigned the same reference numerals as in FIGS. 3 and 26 to omit specific descriptions thereof.

The speech processing apparatus in FIG. 27 is provided with SNR calculating section 2501, speech/noise frame detecting section 2502, noise comb filter reset section 2503 and noise separating comb filter generating section 2504, sets as rejection bands all the frequency passbands of a noise separating comb filter in a frame with no speech component included in an input speech signal, and in this respect, differs from the speech processing apparatus in FIG. 3 or 26.

SNR calculating section 2501 calculates SNR of the speech signal from the first comb filter output from the speech spectrum output from frequency dividing section 104, and outputs a result of the calculation to speech/noise frame detecting section 2502.

Speech/noise frame detecting section 2502 determines whether an input signal is a speech signal or noise signal per frame basis from SNR output from SNR calculating section 2501, and outputs a determination to noise comb filter reset section 2503. Specifically, speech/noise frame detecting section 2502 determines that the input signal is a speech signal (speech frame) when SNR is larger than a predetermined threshold, while determining the input signal is a noise signal (noise frame) when a predetermined number of frames occur successively whose SNR is not more than the predetermined threshold.

When speech/noise frame detecting section 2502 outputs the determination that a frame of the input speech signal includes only a noise component with no speech component, noise comb filter reset section 2503 outputs an instruction for converting all the frequency passbands of the comb filter to rejection bands to noise separating comb filter generating section 2504.

Based on the presence or absence of a speech component in each frequency component, noise separating comb filter generating section 2504 generates a comb filter for enhancing pitch harmonics, and outputs the comb filter to noise separating coefficient calculating section 2402.

Specifically, speech-non-speech identifying section 106 sets at "1" a value of a filter in a frequency component such that the power spectrum of the input speech signal is not less than a result of multiplication of the first threshold used in determination of speech or noise by the power spectrum of the input speech signal, i.e., following equation (23) is satisfied:

$$S^2_f(n,k) \geqq \theta_{nos} \cdot P_{base}(n,k) \tag{23}$$

Meanwhile, speech-non-speech identifying section 106 sets at "0" a value of a filter in a frequency component such that the power spectrum of the input speech signal is less than a result of multiplication of the first threshold used in determination of speech or noise by the power spectrum of the input speech signal, i.e., following equation (24) is satisfied:

$$S^2_f(n,k) < \theta_{nos} \cdot P_{base}(n,k) \tag{24}$$

Herein, $\theta_{nos}$ is a threshold used in noise separation.

Further, when noise separating comb filter generating section 2504 receives the instruction for converting all the frequency passbands of the comb filter to rejection bands from noise comb filter reset section 2503, the section 2504 converts all the frequency passbands of the comb filter to rejection bands according to the instruction.

Thus, according to the speech processing apparatus of this embodiment, when it is determined that a frame of the input speech signal includes only a noise component with no speech component, all the frequency passbands of the comb filter are converted to rejection bands. It is thereby possible to cut off noises in all bands during a signal interval with no speech included, and to obtain excellent noise separating characteristics.

Embodiment 15

Figure 28:
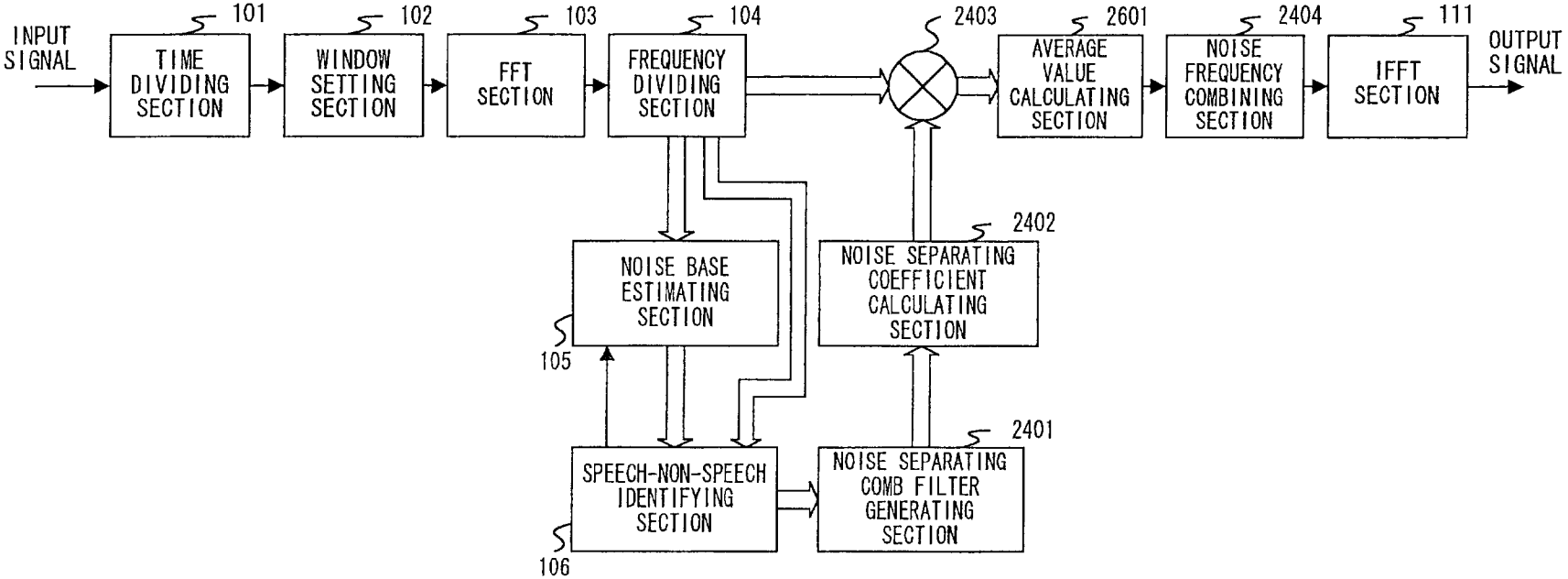
FIG. 28 is a block diagram illustrating an example of a configuration of a speech processing apparatus according to Embodiment 15.

FIG. 28 is a block diagram illustrating an example of a configuration of a speech processing apparatus according to Embodiment 15. In addition, in FIG. 28 sections common to FIGS. 3 and 26 are assigned the same reference numerals as in FIGS. 3 and 26 to omit specific descriptions. The speech processing apparatus in FIG. 28 is provided with average value calculating section 2601, obtains an average value of power of speech spectrum per frequency component basis or average values of power of previously processed frames and of a frame to be processed, and in this respect, differs from the apparatus in FIG. 3 or 26.

With respect to power of the speech spectrum output from frequency dividing section 104, average value calculating section 2601 calculates an average value of such power and peripheral frequency components and an average value of such power and previously processed frames, and outputs the obtained average values to noise frequency combining section 2404. Specifically, an average value of speech spectrum is calculated using equation (6) indicated below.

$$\sum S_f^2(n, k) = \sum_{i=n1}^{n} \sum_{j=k1}^{k2} S_f^2(i, j) \quad (6)$$

where k1 and k2 indicate frequency components and k1<k<k2, n1 is a number indicating a frame previously processed, and n is a number indicating a frame to be processed.

Thus, according to the speech processing apparatus according to Embodiment 15 of the present invention, a power average value of speech spectrum or power average values of previously processed frames and of frames to be processed are obtained for each frequency component, and it is thereby possible to decrease adverse effects of a sudden noise component.

Embodiment 16

Figure 29:
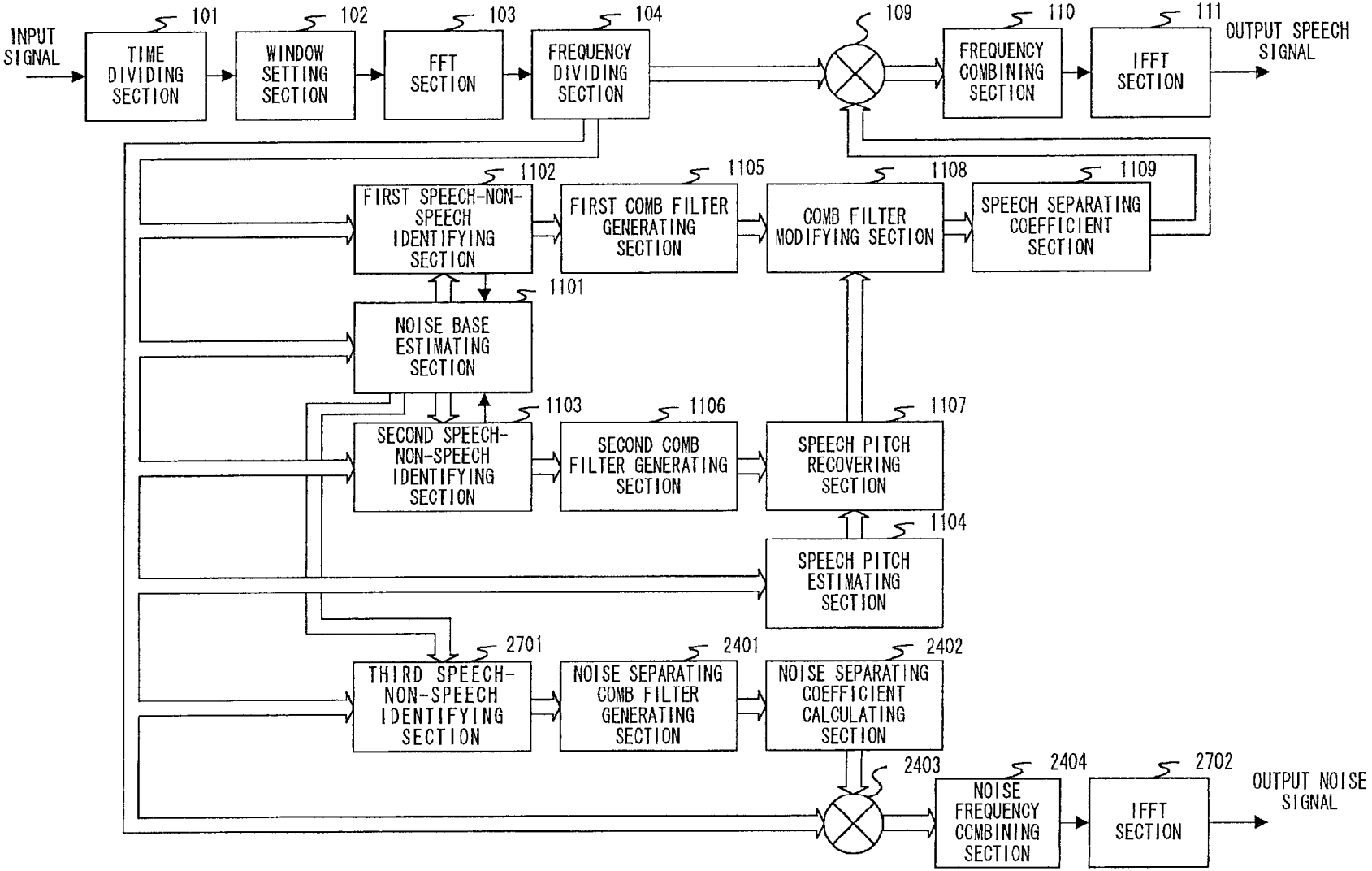
FIG. 29 is a block diagram illustrating an example of a configuration of a speech processing apparatus according to Embodiment 16.

FIG. 29 is a block diagram illustrating an example of a configuration of a speech processing apparatus according to Embodiment 16. In addition, in FIG. 29 sections common to FIG. 3 are assigned the same reference numerals as in FIG. 3 to omit specific descriptions. The speech processing apparatus in FIG. 29 is obtained by combining the speech processing apparatuses in FIGS. 13 and 26 as an example for performing speech enhancement and noise extraction.

In FIG. 29, frequency dividing section 104 divides the speech spectrum output from FFT section 103 into frequency components, and outputs the speech spectrum for each frequency component to noise base estimating section 1101, first speech-non-speech identifying section 1102, second speech-non-speech identifying section 1103, speech pitch estimating section 1104, multiplying section 2403, and third speech-non-speech identifying section 2701.

Noise base estimating section 1101 outputs a noise base previously estimated to first speech-non-speech identifying section 1102 when the section 1102 outputs a determination indicating that the frame includes a speech component. Further, noise base estimating section 1101 outputs the noise base previously estimated to second speech-non-speech identifying section 1103 when the section 1103 outputs a determination indicating that the frame includes a speech component. Similarly, noise base estimating section 1101 outputs the noise base previously estimated to third speech-non-speech identifying section 2701 when the section 2701 outputs a determination indicating that the frame includes a speech component.

Meanwhile, when first speech-non-speech identifying section 1102, second speech-non-speech identifying section 1103, or third speech-non-speech identifying section 2701 outputs a determination indicating that the frame does not include a speech component, noise base estimating section 1101 calculates the short-term power spectrum and a displacement average value indicative of an average value of variations in the spectrum for each frequency component of the speech spectrum output from frequency dividing section 104, further calculates a weighted average value of a previously calculated replacement average value and the power spectrum, and thereby calculates a new replacement average value.

In the case where a difference is not less than a first threshold between the speech spectral signal output from frequency dividing section 104 and a value of the noise base output from noise base estimating section 1101, first speech-non-speech identifying section 1102 determines the signal as a speech portion including a speech component, while in the other case, determining the signal as a non-speech portion with only a noise and no speech component included. First speech-non-speech identifying section 1102 sets the first threshold at a value lower than a second threshold, described later, used in second speech-non-speech identifying section 1103 so that first comb filter generating section 1105 generates a comb filter for extracting pitch harmonic information as much as possible.

Then, first speech-non-speech identifying section 1102 outputs a determination to first comb filter generating section 1105.

In the case where a difference is not less than a second threshold between the speech spectral signal output from frequency dividing section 104 and a value of the noise base output from noise base estimating section 1101, second speech-non-speech identifying section 1103 determines the signal as a speech portion including a speech component, while in the other case, determining the signal as a non-speech portion with only a noise and no speech component included. Then, second speech-non-speech identifying section 1103 outputs a determination to second comb filter generating section 1106.

Based on the presence or absence of a speech component in each frequency component, first comb filter generating section 1105 generates a first comb filter for enhancing pitch harmonics to output to comb filter modifying section 1108.

Speech pitch estimating section 1104 estimates a speech pitch period from the speech spectrum output from frequency dividing section 104, and outputs an estimation to speech pitch recovering section 1107. Speech pitch recovering section 1107 recovers the second comb filter based on the estimation output from speech pitch estimating section 1104 to output to comb filter modifying section 1108.

Using the pitch recover comb filter generated in speech pitch recovering section 1107, comb filter modifying section 1108 modifies the first comb filter generated in first comb filter generating section 1105, and outputs the modified comb filter to speech separating coefficient calculating section 1109.

Speech separating coefficient calculating section 1109 multiplies the comb filter modified in comb filter modifying section 1108 by a separating coefficient based on frequency characteristics, and calculates a separating coefficient of an input signal for each frequency component to output to multiplying section 109. Multiplying section 109 multiplies the speech spectrum output from frequency dividing section 104 by the separating coefficient output from speech separating coefficient calculating section 1109 per frequency component basis. Then, the section 109 outputs the spectrum resulting from the multiplication to frequency combining section 110.

In the case where a difference is not less than a predetermined threshold between the speech spectral signal output from frequency dividing section 104 and a value of the noise base output from noise base estimating section 1101, third speech-non-speech identifying section 2701 determines the signal as a speech portion including a speech component, while in the other case, determining the signal as a non-speech portion with only a noise and no speech component included. Then, third speech-non-speech identifying section 2701 outputs the determination to noise base estimating section 1101 and noise separating comb filter generating section 2401.

Based on the presence or absence of a speech component in each frequency component, noise separating comb filter generating section 2401 generates a comb filter for enhancing the speech pitch, and outputs the comb filter to noise separating coefficient calculating section 2402. Noise separating coefficient calculating section 2402 multiplies the comb filter generated in noise separating comb filter generating section 2401 by an attenuation coefficient based on the frequency characteristics, sets an attenuation coefficient of an input signal for each frequency component, and outputs the attenuation coefficient of each frequency component to multiplying section 2403.

Multiplying section 2403 multiplies the speech spectrum output from frequency dividing section 104 by a noise separating coefficient output from noise separating coefficient calculating section 2402 per frequency component basis. Then, the section 2402 outputs the spectrum resulting from the multiplication to noise frequency combining section 2404. Noise frequency combining section 2404 combines spectra of frequency component basis output from multiplying section 2403 to a speech spectrum continuous in a frequency region per unit processing time basis to output to IFFT section 2702.

IFFT section 2702 performs IFFT on the speech spectrum output from noise frequency combining section 2404, and outputs thus converted speech signal.

In this way, according to the speech processing apparatus in this embodiment, it is determined a spectral signal is of speech or non-speech per frequency component basis, frequency characteristics are attenuated based on the determination per frequency component basis, and it is thereby possible to obtain accurate pitch information. Therefore, it is possible to perform speech enhancement with less speech distortions even when noise suppression is performed by large attenuation. Further, it is possible to perform noise extraction at the same time.

In addition, an example of the combination of the speech processing apparatuses of the present invention is not limited to the speech processing apparatus of Embodiment 16, and the above-mentioned embodiments are capable of being carried into practice in a combination thereof as appropriate.

Further, while the speech enhancement and noise extraction according to the above-mentioned embodiments is explained using a speech processing apparatus, the speech enhancement and noise extraction is capable of being achieved by software. For example, a program for performing the above-mentioned speech enhancement and noise extraction may be stored in advance in ROM (Read Only Memory) to be operated with CPU (Central Processor Unit).

Furthermore, it may be possible that the above-mentioned program for performing the speech enhancement and noise extraction is stored in a computer readable storage medium, the program stored in the storage medium is stored in RAM (Random Access Memory) in a computer, and the computer executes the processing according to the program. Also in such a case, the same operations and effectiveness as in the above-mentioned embodiments are obtained.

Still furthermore, it may be possible that the above-mentioned program for performing the speech enhancement is stored in a server to be transferred to a client, and the client executes the program. Also in such a case, the same operations and effectiveness as in the above-mentioned embodiments are obtained.

Moreover, the speech processing apparatus according to one of the above-mentioned embodiments is capable of being mounted on a radio communication apparatus, communication terminal, base station apparatus or the like. As a result, it is possible to perform speech enhancement or noise extraction on a speech in communications.

As is apparent from the foregoing, it is possible to identify a speech spectrum per frequency component basis as a region with a speech component or a region with no speech component, suppress a noise based on an accurate speech pitch obtained from the identification information, and to cancel the noise adequately with less speech distortions.

This application is based on the Japanese Patent Applications No.2000-264197 filed on Aug. 31, 2000, and No.2001-259473, Aug. 29, 2001, entire contents of which are expressly incorporated by reference herein.

INDUSTRIAL APPLICABILITY

The present invention is suitable for use in a speech processing apparatus and a communication terminal provided with a speech processing apparatus.

The invention claimed is:

1. A speech processing apparatus comprising:

a frequency dividing section that divides a speech spectrum of an input speech signal into predetermined frequency bands;

a speech identifying section that identifies whether or not each frequency band of the speech spectrum includes a speech component based on the frequency-divided speech spectrum and a noise base that is a spectrum of a noise component;

a comb filter generating section that generates a comb filter in which frequency bands containing speech components are passed and frequency bands containing non-speech components are attenuated;

a pitch frequency estimating section that estimates a speech pitch frequency;

a pitch modifying section that modifies the width of pitch harmonics in the comb filter based on the speech pitch frequency and the divided speech spectra;

a noise suppressing section that multiplies attenuation coefficients that are based on frequency characteristics of the comb filter with the modified width of pitch harmonics and sets the attenuation coefficients of the respective predetermined frequency bands, and suppresses a noise component of the divided speech spectra by multiplying the divided speech spectra by the attenuation coefficients of the corresponding frequency bands; and a frequency combining section that combines the frequency-divided speech spectrum in which the noise component is suppressed with a speech spectrum continuous in a frequency region.

2. The speech processing apparatus according to claim 1, wherein the speech identifying section identifies that a band of the frequency-divided speech spectrum includes a speech component when a difference between the power of the speech spectrum and the power of a noise base is greater than a predetermined threshold and identifies that the speech spectrum does not include a speech component when the difference is not greater than the threshold.

3. The speech processing apparatus according to claim 2, further comprising a threshold adjusting section that increases the threshold when the number of frequency components in the passband of the comb filter is greater than a predetermined number and decreases the threshold when the number of frequency components in the passband in the comb filter is less than the predetermined number.

4. The speech processing apparatus according to claim 3, further comprising a musical noise suppressing section that makes all of the comb filter a passband when the number of frequency components in the passband of the comb filter is less than the predetermined number.

5. The speech processing apparatus according to claim 1, further comprising:

an average value calculating section that calculates an average value of the power of the divided speech spectra, wherein the speech identifying section identifies that a band of the frequency-divided speech spectra includes a speech component when the difference between the average power of the divided speech spectra and the power of a noise base is greater than a predetermined threshold and identifies that a band of the frequency-divided speech spectra does not include a speech component when the difference is less than the threshold.

6. The speech processing apparatus according to claim 1, further comprising a noise base estimating section that updates a noise base of a frequency region that does not include a speech component, based on an average value of previously estimated noise bases and a weighted average value of power of the divided speech spectra.

7. The speech processing apparatus according to claim 1, wherein the noise suppressing section attenuates the divided speech spectra in the rejection band of the comb filter.

8. A speech processing apparatus comprising:

a frequency dividing section that divides a speech spectrum of an input speech signal into predetermined frequency bands;

a first speech and non-speech identifying section that identifies whether or not each frequency band of the divided speech spectra includes a speech component;

a first comb filter generating section that generates a first comb filter in which frequency bands containing a speech component are passed and frequency bands not containing a speech component are rejected, based on results identified in the first speech and non-speech identifying section;

a second speech and non-speech identifying section that identifies whether or not each frequency band of the divided speech spectra includes a speech component according to a different criterion than the first speech and non-speech identifying section;

a second comb filter generating section that generates a second comb filter in which frequency bands containing a speech component are passed and frequency bands not containing a speech component are rejected, based on results identified in the second speech and non-speech identifying section;

a speech pitch estimating section that estimates a pitch frequency of the input speech signal from the divided speech spectra;

a speech pitch recovering section that recovers pitch harmonics in the second comb filter based on the pitch frequency estimated in the speech pitch estimating section and generates a pitch recovery comb filter;

a comb filter modifying section that modifies the first comb filter based on the pitch recovery comb filter and generates a modified comb filter;

a noise suppressing section that suppresses a noise component of the divided speech spectra by multiplying attenuation coefficients that are based on frequency characteristics of the modified comb filter and setting the attenuation coefficients of the respective predetermined frequency region units, and by multiplying the divided speech spectra by the attenuation coefficients of the corresponding frequency region units; and a frequency combining section that combines the divided speech spectra in which the noise component is suppressed with a speech spectrum continuous in a frequency region.

9. The speech processing apparatus according to claim 8, wherein:

the first speech and non-speech identifying section identifies that the frequency bands of the divided speech spectra include a speech component when a difference between a power of the divided speech spectra and a power of a noise base, said noise base being a spectrum of a noise component, is greater than a first predetermined threshold, and identifies that the frequency bands of the divided speech spectra do not include a speech component when the difference is less than the first threshold; and the second speech and non-speech identifying section identifies that the frequency bands of the divided speech spectra include a speech component when the difference between the power of the divided speech spectra and the power of the noise base is greater than a second predetermined threshold, said second threshold being greater than the first threshold, and identifies that the frequency bands of the divided speech spectra do not include a speech component when the difference is less than the second threshold.

10. The speech processing apparatus according to claim 9, further comprising an average value calculating section that calculates an average value of the power the divided speech spectra, wherein the second speech and non-speech identifying section identifies that the frequency bands of the divided speech spectra include a speech component when the difference between the average value of the power of the divided speech spectra and the power of the noise base is greater than the second predetermined threshold, and identifies that the frequency bands of the divided speech spectra do not include a speech component when the difference is less than the second threshold.

11. The speech processing apparatus according to claim 8, further comprising:

an SNR calculating section that calculates a signal to noise ratio of the input speech signal from the power of the divided speech spectra and one of the first and second comb filters; and a speech and noise frame detecting section that detects a speech frame or a noise frame based on the signal to noise ratio, wherein, when a speech frame is detected in the speech and noise frame detecting section, the speech pitch estimating section estimates the pitch frequency.

12. The speech processing apparatus according to claim 11, further comprising a comb filter reset section that makes all of the modified comb filter a passband when a noise frame is detected in the speech and noise frame detecting section.

13. The speech processing apparatus according to claim 8, wherein, among frequency components in the passband of the first comb filter, the comb filter modifying section makes a frequency component that overlaps with a frequency region in a passband of the modified comb filter and makes another frequency region a rejection band of the modified comb filter.

14. The speech processing apparatus according to claim 8, further comprising:

a first musical noise suppressing section that makes all of the first comb filter a passband when the number of frequency components in the passband of the first comb filter is less than a predetermined number; and a second musical noise suppressing section that makes all of the second comb filter a passband when the number of frequency components in the passband of the second comb filter is less than the predetermined number.

15. A speech processing method comprising:

a frequency dividing step of dividing a speech spectrum of an input speech signal into predetermined frequency bands;

a speech and non-speech identifying step of identifying whether or not each frequency band of the divided speech spectra includes a speech component;

a pitch harmonic structure generating step of generating a pitch harmonic structure that enhances frequency bands including a speech component;

a pitch frequency estimating step of estimating a speech pitch frequency;

a pitch modifying step of modifying a width of pitch harmonics in the pitch harmonic structure based on the speech pitch frequency and the divided speech spectra;

an attenuation coefficient setting step of multiplying attenuation coefficients that are based on frequency characteristics by the modified pitch harmonic structure and setting the attenuation coefficients of the respective predetermined frequency region units;

a noise suppressing step of suppressing a noise component of the divided speech spectra by multiplying the divided speech spectra by the attenuation coefficients of the corresponding frequency region units; and a frequency combining step of combining the divided speech spectra in which the noise component is suppressed with a speech spectrum continuous in a frequency region.

16. A speech processing method comprising:

a frequency dividing step of dividing a speech spectrum of an input speech signal into predetermined frequency bands;

a first speech and non-speech identifying step of identifying whether or not each frequency band of the divided speech spectra includes a speech component;

a first comb filter generating step of generating a comb filter in which frequency bands containing a speech component are passed and frequency bands not containing a speech component are rejected, based on results identified in the first speech and non-speech identifying step;

a second speech and non-speech identifying step of identifying whether or not each frequency band of the divided speech spectra includes a speech component according to a different criterion than the first speech and non-speech identifying step;

a second comb filter generating step of generating a second comb filter in which frequency bands containing a speech component are passed and frequency bands not containing a speech component are rejected, based on results identified in the second speech and non-speech identifying step;

a speech pitch estimating step of estimating a pitch frequency of the input speech signal from the divided speech spectra;

a speech pitch recovering step of recovering pitch harmonics in the second comb filter based on the pitch frequency estimated in the speech pitch estimating step and generating a pitch recovery comb filter;

a comb filter modifying step of modifying the first comb filter based on the pitch recovery comb filter and generating a modified comb filter;

a noise suppressing step of suppressing a noise component of the divided speech spectra by multiplying attenuation coefficients that are based on frequency characteristics of the modified comb filter and setting the attenuation coefficients of the respective predetermined frequency region units, and by multiplying the divided speech spectra by the attenuation coefficients of the corresponding frequency region-units; and a frequency combining step of combining the divided speech spectra in which the noise component is suppressed with a speech spectrum continuous in a frequency region.

17. A speech processing method comprising:

a frequency dividing step of dividing a speech spectrum of an input speech signal into predetermined frequency bands;

a difference calculating step of calculating a difference between a power of the divided speech spectra and a power of a noise base, said noise base being a spectrum of a noise component;

a first speech and non-speech identifying step of identifying that frequency bands of the divided speech spectra include a speech component when the difference is greater than a first predetermined threshold;

a first pitch harmonic structure generating step of generating a first pitch harmonic structure that enhances a frequency region identified to include a speech component;

a second speech and non-speech identifying step of identifying that frequency bands of the divided speech spectra include a speech component when the difference is greater than a second threshold that is greater than the first threshold;

a second pitch harmonic structure generating step of generating a second pitch harmonic structure that enhances a frequency region identified to include a speech component;

a pitch frequency estimating step of estimating the pitch frequency of the input speech signal from the divided speech spectra;

a third pitch harmonic structure generating step of generating a third pitch harmonic structure, said third pitch harmonic structure being the second pitch harmonic structure from which only peak information is extracted;

a fourth pitch harmonic structure generating step of generating a fourth pitch harmonic structure, said fourth pitch harmonic structure being the third pitch harmonic structure in which peak information is inserted in a portion in the third pitch harmonic structure that corresponds to the estimated pitch frequency;

a fifth pitch harmonic structure generating step of generating a fifth pitch harmonic structure, said fifth pitch structure being the fourth pitch structure in which a width of the peak information is increased according to a value of the pitch frequency;

a sixth pitch harmonic structure generating step of generating a sixth pitch harmonic structure that enhances only a frequency region that is enhanced by both the first pitch harmonic structure and the fifth pitch harmonic structure;

an attenuation coefficient setting step of multiplying attenuation coefficients that are based on frequency characteristics by the sixth pitch harmonic structure and setting the attenuation coefficients of the respective predetermined frequency region units;

a noise suppressing step of suppressing a noise component of the divided speech spectra by multiplying the divided speech spectra by the attenuation coefficients of the corresponding frequency region units; and a frequency combining step of combining the divided speech spectra in which the noise component is suppressed with a speech spectrum continuous in a frequency region.

* * * * *